US010409214B2

(12) United States Patent
Lee et al.

(10) Patent No.: US 10,409,214 B2
(45) Date of Patent: Sep. 10, 2019

(54) PRESSURIZING UNIT TO APPLY FORCE TO DEVELOPING UNIT OF DEVELOPMENT CARTRIDGE

(71) Applicant: HP PRINTING KOREA CO., LTD., Suwon-si, Gyeonggi-do (KR)

(72) Inventors: Sang-Hoon Lee, Suwon-si (KR); Joon-Hee Kim, Suwon-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 61 days.

(21) Appl. No.: 16/017,635

(22) Filed: Jun. 25, 2018

(65) Prior Publication Data

US 2018/0307179 A1 Oct. 25, 2018

Related U.S. Application Data

(63) Continuation of application No. PCT/KR2016/009314, filed on Aug. 23, 2016.

(30) Foreign Application Priority Data

Dec. 28, 2015 (KR) ..... 10-2015-0187633

(51) Int. Cl.
*G03G 21/16* (2006.01)
*G03G 15/06* (2006.01)
(Continued)

(52) U.S. Cl.
CPC ..... *G03G 21/1647* (2013.01); *G03G 15/06* (2013.01); *G03G 21/1821* (2013.01);
(Continued)

(58) Field of Classification Search
None
See application file for complete search history.

(56) References Cited

U.S. PATENT DOCUMENTS 4,862,212 A * 8/1989 Tanzawa ..... G03G 15/0896 399/110
7,869,740 B2 * 1/2011 Yoshimura ..... G03G 21/1825 399/111
(Continued)

FOREIGN PATENT DOCUMENTS

JP 2009-181002 A 8/2009
KR 10-2011-0071440 A 6/2011
(Continued)

*Primary Examiner* — David M. Gray
*Assistant Examiner* — Geoffrey T Evans
(74) *Attorney, Agent, or Firm* — Staas & Halsey LLP

(57) ABSTRACT

A development cartridge detachable from a main body of an image forming apparatus includes a photosensitive unit including a photosensitive drum and a developing unit including a developing roller. The developing unit is coupled to the photosensitive unit such that the developing unit is movable to a development position where a development nip forms by contact between the developing roller and the photosensitive drum and movable to a release position where the development nip is released. The development cartridge further includes a pressurizing unit movable to a first position where the pressurizing unit applies an elastic force to the developing unit in a direction such that the developing unit is maintained in the development position, and movable to a second position where the pressurizing unit applies an elastic force to the developing unit in a direction such that the developing unit is maintained in the release position.

16 Claims, 20 Drawing Sheets

(51) Int. Cl.
*G03G 21/18* (2006.01)
*G03G 15/08* (2006.01)

(52) U.S. Cl.
CPC ..... *G03G 15/0865* (2013.01); *G03G 21/1853* (2013.01); *G03G 2215/066* (2013.01)

(56) References Cited

U.S. PATENT DOCUMENTS

| | | | | |
|---|---|---|---|---|
| 9,026,002 | B2 * | 5/2015 | Sato | G03G 21/1821 399/119 |
| 2018/0136604 | A1 * | 5/2018 | Lee | G03G 21/1825 |
| 2019/0137904 | A1 * | 5/2019 | Jung | G03G 21/1825 |

FOREIGN PATENT DOCUMENTS

| | | | |
|---|---|---|---|
| KR | 10-2012-0079937 | A | 7/2012 |
| KR | 10-2015-0127501 | A | 11/2015 |
| KR | 10-2010-0132755 | A | 12/2015 |

* cited by examiner

PRESSURIZING UNIT TO APPLY FORCE TO DEVELOPING UNIT OF DEVELOPMENT CARTRIDGE

CROSS REFERENCE TO RELATED APPLICATIONS

This application is a continuation of International Application No. PCT/KR2016/009314 filed on Aug. 23, 2016. The International Application claims the priority benefit of Korean Patent Application No. 10-2015-0187633 filed on Dec. 28, 2015. Both the International Application and the Korean Patent Application are incorporated by reference herein in their entirety.

BACKGROUND

The disclosure relates to an electrophotographic image forming apparatus for forming an image on a recording medium in an electrophotographic manner, and a development cartridge capable of being detachably attached to the electrophotographic image forming apparatus.

An electrophotographic image forming apparatus operating in an electrophotographic manner prints an image onto a recording medium by forming a visible toner image on a photoconductor by supplying a toner to an electrostatic latent image formed on the photoconductor, transferring the toner image to the recording medium, and fixing the transferred toner image to the recording medium.

A development cartridge is an assembly of elements for forming the visible toner image. The development cartridge is detachably attached to a main body of the image forming apparatus and is a consumable item that is replaced when its service life is over. In a development cartridge using a contact development method, a developing roller and a photoconductor contact each other, thereby forming a development nip.

Once a long period of time has elapsed after the formation of the development nip, the developing roller may be deformed and the photoconductor may be damaged. The deformation of the developing roller and the damage to the photoconductor may cause a change in the development nip and thus may reduce image quality.

DETAILED DESCRIPTION

Figure 1:
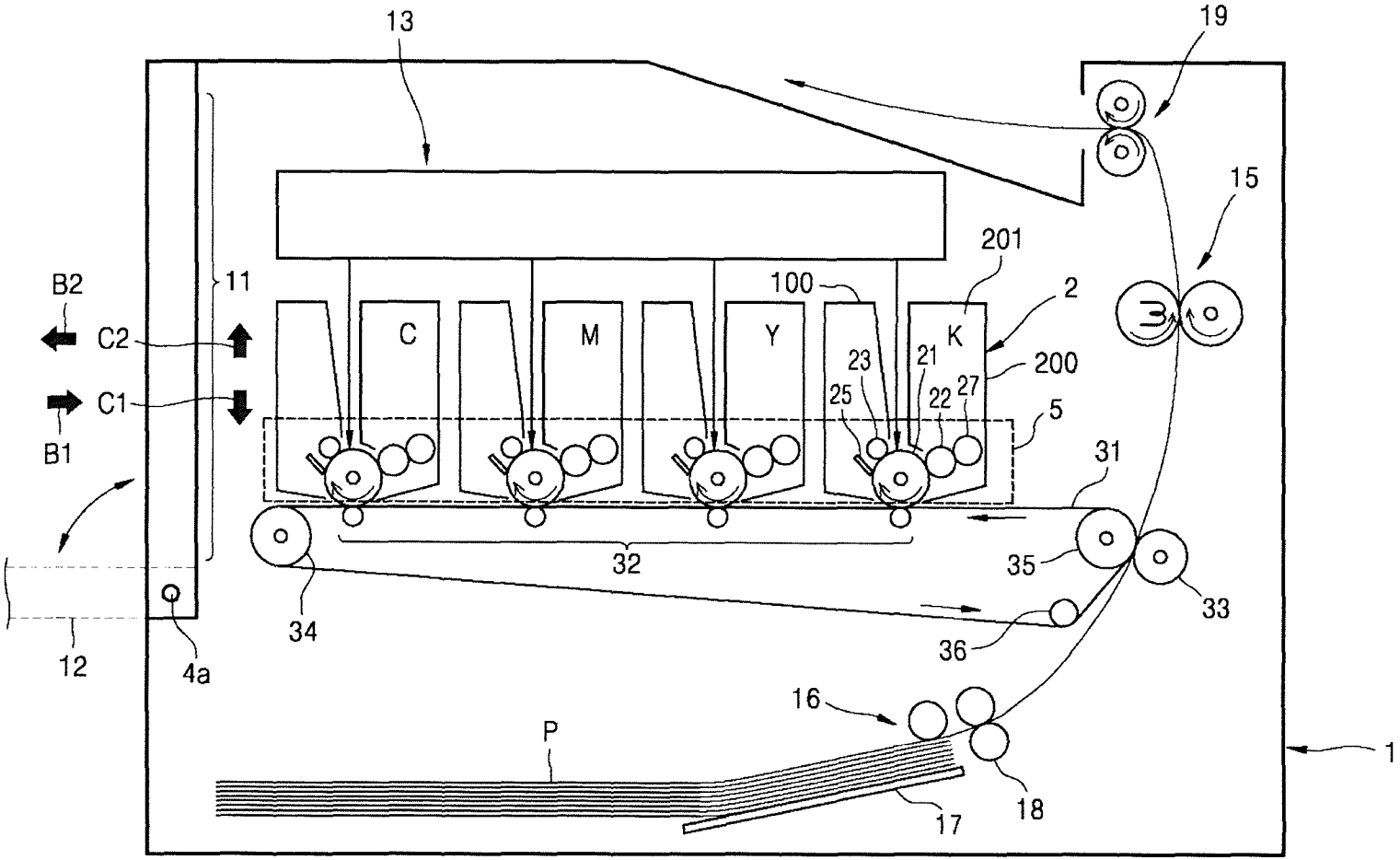
FIG. 1 is a schematic configuration diagram illustrating an electrophotographic image forming apparatus according to an example.

Hereinafter, examples of an electrophotographic image forming apparatus and a development cartridge will be described in detail with reference to the accompanying drawings. Elements having substantially the same configurations are denoted by the same reference numerals in the specification and the accompanying drawings, and thus, a repeated description thereof is omitted.

Described herein are a development cartridge capable of easily forming/releasing a development nip through a simple structure, and an electrophotographic image forming apparatus employing the development cartridge.

According to the disclosure, a development cartridge detachable from a main body of an image forming apparatus may include a photosensitive unit including a photosensitive drum, a developing unit including a developing roller, the developing unit being coupled to the photosensitive unit such that the developing unit is movable to a development position where a development nip forms by contact between the developing roller and the photosensitive drum and movable to a release position where the development nip is released, and a pressurizing unit to be shifted to a first position where the pressurizing unit applies an elastic force to the developing unit in a direction such that the developing unit is maintained in the development position, and is shifted to a second position where the pressurizing unit applies an elastic force to the developing unit in a direction such that the developing unit is maintained in the release position.

According to the disclosure, an electrophotographic image forming apparatus may include a main body, and the above-described development cartridge, which is detachable from the main body.

According to examples of a development cartridge and an electrophotographic image forming apparatus, a development nip may be formed/released in a state in which the development cartridge is separated from a main body.

According to examples of a development cartridge and an electrophotographic image forming apparatus, a development nip may be formed by mounting the development cartridge on a main body.

According to examples of a development cartridge and an electrophotographic image forming apparatus, a development nip may be formed by detaching the development cartridge from a main body.

FIG. 1 is a schematic configuration diagram illustrating an electrophotographic image forming apparatus, according to an example. An image forming apparatus according to the example prints a color image to a recording medium P in an electrophotographic manner. Referring to FIG. 1, the image forming apparatus may include a main body 1, a plurality of development cartridges 2, an exposure device 13, a transfer device, and a fuser 15.

For color printing, the plurality of development cartridges 2 may include four development cartridges 2 for developing images with cyan color, magenta color, yellow color, and black color, respectively. Toners, of cyan (C) color, magenta (M) color, yellow (Y) color, and black (K) color may be contained in the four development cartridges 2, respectively. Although not illustrated, the toners of cyan color, magenta color, yellow color, and black color may be respectively contained in four toner supply containers, and may be respectively supplied from the four toner supply containers to the four development cartridges 2. The image forming apparatus may further include development cartridges 2 for containing and developing toners of other various colors such as light magenta color and white color. Hereinafter, the image forming apparatus including the four development cartridges 2 will be described, and unless there is a particular description contrary thereto, items with reference characters C, M, Y, and K indicate elements for developing images with cyan color, magenta color, yellow color, and black color, respectively.

The main body 1 includes an opening 11 that provides a path for mounting/detaching the plurality of development cartridges 2. A cover 12 opens and closes the opening 11. The exposure device 13, the transfer device, and the fuser 15 are arranged at the main body 1. In addition, a recording medium transport unit for loading and transporting the recording medium P where an image is to be formed is arranged at the main body 1.

In the example, each of the plurality of development cartridges 2 is an integrated development cartridge. Each development cartridge 2 may include a photosensitive unit 100 and a developing unit 200.

The photosensitive unit 100 includes a photosensitive drum 21. The photosensitive drum 21, as a photoconductor on which an electrostatic latent image is formed, may include a conductive metal pipe and a photosensitive layer formed at an outer circumference of the conductive metal pipe. A charging roller 23 is an example of a charger that charges a surface of the photosensitive drum 21 to have a uniform surface potential. Instead of the charging roller 23, a charging brush, a corona charger, or the like may be used. The photosensitive unit 100 may further include a cleaning roller (not shown) for removing foreign substances attached to a surface of the charging roller 23. A cleaning blade 25 is an example of a cleaning member that removes residual toners and foreign substances attached to the surface of the photosensitive drum 21 after a transfer process described below. Instead of the cleaning blade 25, a cleaning device in another form, such as a rotating brush, may be used.

The developing unit 200 includes a toner container 201. The developing unit 200 supplies a toner in the toner container 210 to an electrostatic latent image formed on the photosensitive drum 21, thereby developing the electrostatic latent image into a visible toner image. A developing method may include a one-component developing method using a toner and a two-component developing method using a toner and a carrier. In the example, the developing unit 200 employs the one-component developing method. A developing roller 22 supplies a toner to the photosensitive drum 21. A developing bias voltage may be applied to the developing roller 22 to supply the toner to the photosensitive drum 21.

The one-component developing method may be classified into a contact development technique in which the developing roller 22 and the photosensitive drum 21 rotate while contacting each other and a non-contact development technique in which the developing roller 22 and the photosensitive drum 21 rotate while being separate from each other by tens to hundreds of microns. In the example, a contact development technique in which the developing roller 22 and the photosensitive drum 21 contact each other and thus form a development nip N is used. A supply roller 27 supplies the toner in the toner container 201 to a surface of the developing roller 22. To this end, a supply bias voltage may be applied to the supply roller 27. The developing unit 20 may further include a regulating member (not shown) for regulating an amount of toner to be supplied by the developing roller 22 to the development nip N where the photosensitive drum 21 and the developing roller 22 contact each other. For example, the regulating member may be a doctor blade that elastically contacts the surface of the developing roller 22.

The exposure device 13 radiates light modulated in correspondence with image information onto the photosensitive drum 21 and thus forms the electrostatic latent image on the photosensitive drum 21. Examples of the exposure device 13 may include a laser scanning unit (LSU) using a laser diode as a light source and a light-emitting diode (LED) exposure device using an LED as a light source.

The transfer device may include an intermediate transfer belt 31, first transfer rollers 32, and a second transfer roller 33. The intermediate transfer belt 31 temporarily receives a toner image developed on the photosensitive drum 21 of each of the development cartridges 2C, 2M, 2Y, and 2K. The intermediate transfer belt 31 is circulated while being supported by supporting rollers 34, 35, and 36. Four first transfer rollers 32 are positioned to face the photosensitive drums 21 of the development cartridges 2C, 2M, 2Y, and 2K with the intermediate transfer belt 31 therebetween. A first transfer bias voltage is applied to the four first transfer rollers 32 to firstly transfer toner images, which are developed on the photosensitive drums 21, to the intermediate transfer belt 31. Instead of the first transfer rollers 32, a corona transfer device or a pin scorotron-type transfer device may be used. The second transfer roller 33 is positioned to face the intermediate transfer belt 31. A second transfer bias voltage is applied to the second transfer roller 33 to transfer, to the recording medium P, the toner images that are firstly-transferred to the intermediate transfer belt 31.

When a print command is transmitted from a host (not shown), etc., a controller (not shown) charges, by using the charging roller 23, the surface of the photosensitive drum 21 to have a uniform surface potential. The exposure device 13 forms electrostatic latent images on the photosensitive drums 21 by scanning four light beams to the photosensitive drums 21 of the development cartridges 2C, 2M, 2Y, and 2K, the four light beams being modulated according to image information corresponding to cyan, magenta, yellow, and black colors, respectively. The developing rollers 22 of the development cartridges 2C, 2M, 2Y, and 2K supply C, M, Y, and K toners to the photosensitive drums 21, respectively, thereby developing the electrostatic latent images into visible toner images. The developed toner images are firstly transferred to the intermediate transfer belt 31. Recording media P loaded on a loading plate 17 are output one by one by a pick-up roller 16, and are transported to a transfer nip by a feed roller 18, the transfer nip being formed by the second transfer roller 33 and the intermediate transfer belt 31. The toner images that are firstly-transferred to the intermediate transfer belt 31 are secondly transferred to the recording medium P due to the second transfer bias voltage applied to the second transfer roller 33. When the recording medium P passes through the fuser 15, the toner images are fixed on the recording medium P due to heat and pressure. The recording medium P on which fixing has been completed is externally discharged by a discharge roller 19.

The development cartridges 2C, 2M, 2Y, and 2K may be sequentially detachably attached to the main body 1 through the opening 11 opened by the door 12. That is, the plurality of development cartridges 2 may be mounted on the main body 1 by opening the door 12 and causing the development cartridges 2 to slide in a mounting direction B1. Also, the development cartridges 2 may be detached from the main body 1 by opening the door 12 and causing the development cartridges 2 to slide in a removal direction B2.

To prevent the photosensitive drum 21 from being damaged due to contact between the photosensitive drum 21 and the intermediate transfer belt 31 during a process of mounting the development cartridge 2, at the beginning of mounting, the development cartridge 2 may slide in the mounting direction B1 in a state in which the photosensitive drum 1 is separate from the intermediate transfer belt 31, and may be guided by a guide unit (not shown) in the main body 1 to allow the photosensitive drum 21 to contact the intermediate transfer belt 31 when the development cartridge 2 reaches a mounting position.

Figure 2:
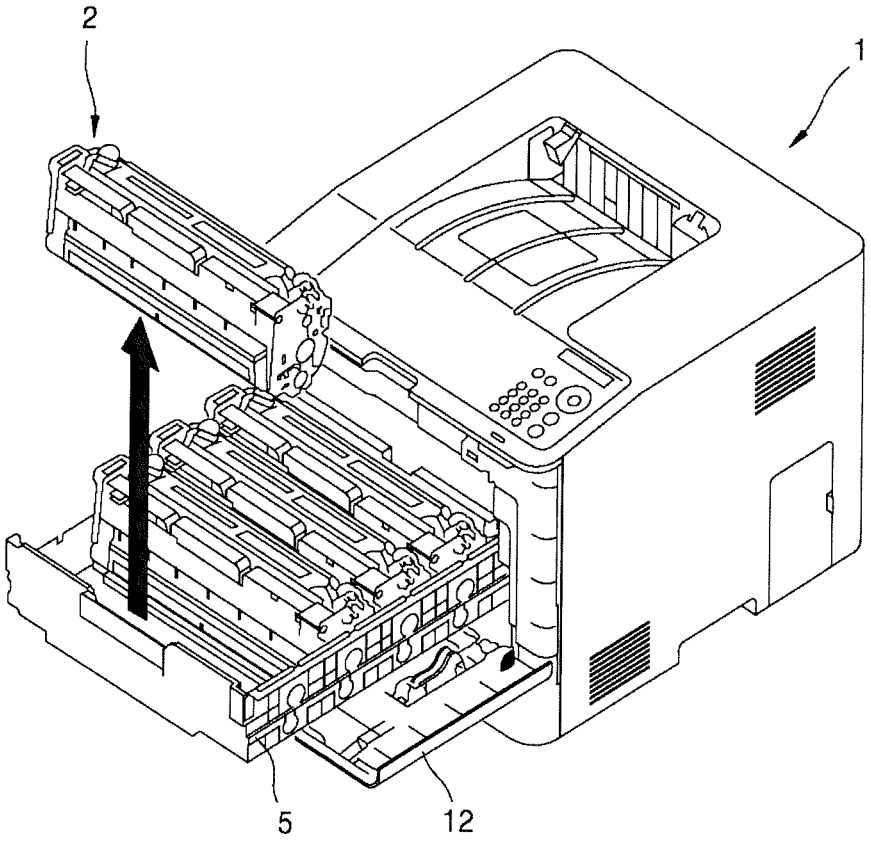
FIG. 2 is a perspective view illustrating an example of a method of mounting a development cartridge on a main body.

The development cartridges 2C, 2M, 2Y, and 2K may be mounted on the main body 12 in a tray manner. FIG. 2 is a perspective view illustrating an example of a method of mounting the development cartridges 2C, 2M, 2Y, and 2K on the main body 1. Referring to FIG. 2, the main body 1 includes a tray 5 which is loaded with the development cartridges 2C, 2M, 2Y, and 2K and enters the main body 1. For example, after the door 12 is opened, and the tray 5 is brought out of the main body 1 by causing the tray 5 to slide in the removal direction B2, the development cartridges 2C, 2M, 2Y, and 2K may be loaded on the tray 5. Next, the tray 5 may be inserted into the main body 1 by causing the tray 5 to slide in the mounting direction B1, and the door 12 may be closed.

To prevent the photosensitive drum 21 from being damaged due to contact between the photosensitive drum 21 and the intermediate transfer belt 31 during a process of inserting the tray 5 into the main body 1, the photosensitive drum 21 may be separate from the intermediate transfer belt 31 until the tray 5 is inserted into the main body 1 and the door 12 is closed. That is, the tray 5 may slide and enter the main body 1 in a state in which the photosensitive drum 21 is spaced apart from the intermediate transfer belt 31. When the tray 5 is inserted into the main body 1, and the door 12 is closed, the tray 5 is moved in a descending direction C1 by a closing operation of the door 12 to access the intermediate transfer belt 31, and the photosensitive drum 21 contacts the intermediate transfer belt 31. When the door 12 is opened, the tray 5 is moved in an ascending direction C2 and is separated from the intermediate transfer belt 31. By causing the tray 5 to slide in this state, the tray 5 may be withdrawn from the main body 1 as illustrated in FIG. 2.

Figure 3:
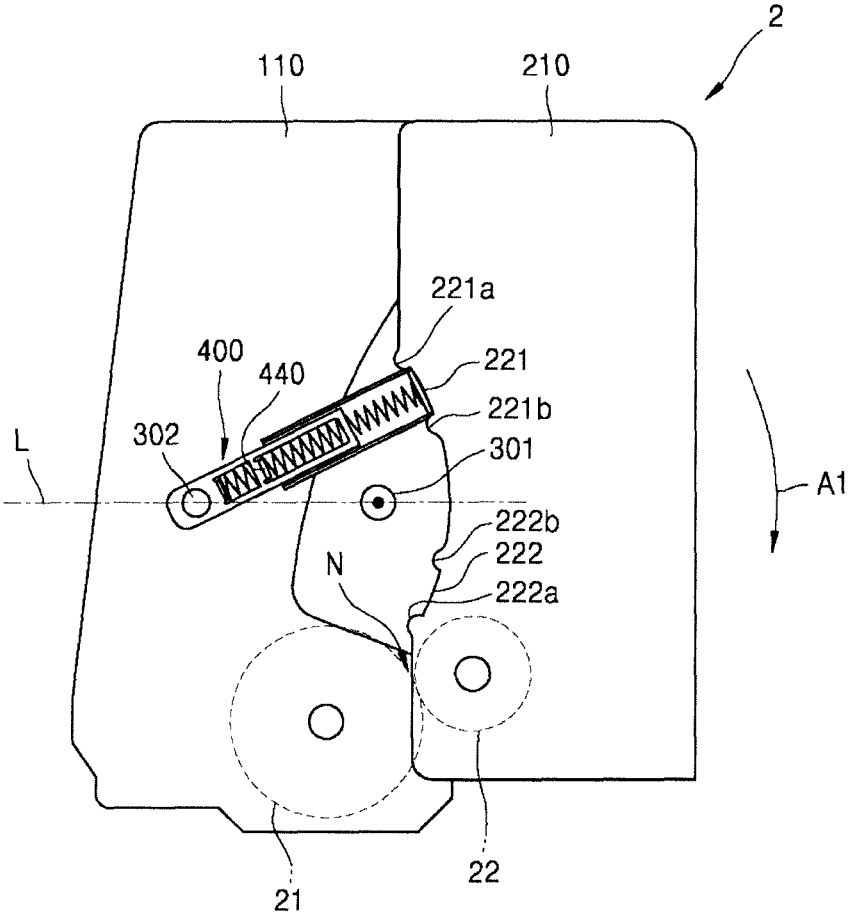
FIG. 3 is a side view of a development cartridge according to an example, which illustrates a state in which a photosensitive drum and a developing roller contact each other to form a development nip.
Figure 4:
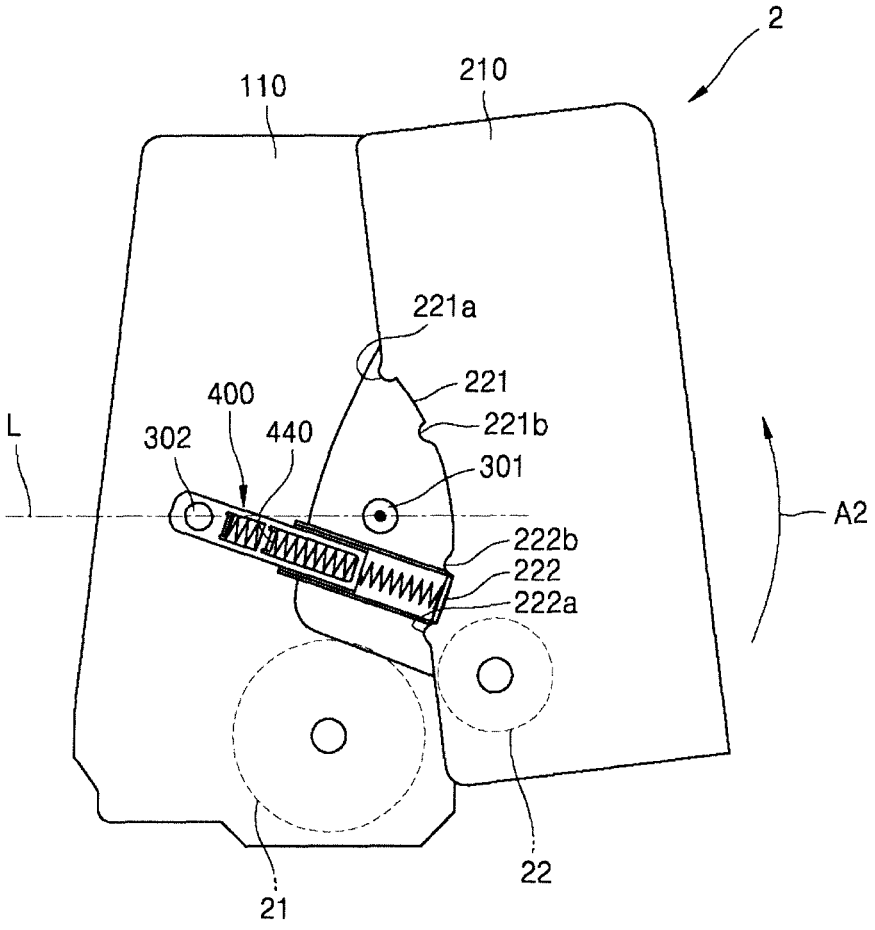
FIG. 4 is a side view of a development cartridge according to an example, which illustrates a state in which a photosensitive drum and a developing roller are separated from each other to release a development nip.

FIGS. 3 and 4 each are side views illustrating the development cartridge 2 according to an example. FIG. 3 illustrates a state in which the photosensitive drum 21 and the developing roller 22 contact each other to form the development nip N, and FIG. 4 illustrates a state in which the photosensitive drum 21 and the developing roller 22 are separated from each other to release the development nip N.

Referring to FIGS. 3 and 4, the development cartridge 2 includes the photosensitive unit 100 and the developing unit 200. The photosensitive unit 100 includes a first frame 110 and the photosensitive drum 21 supported by the first frame 110. The developing unit 200 includes a second frame 210 and the developing roller 22 supported by the second frame 210. The developing unit 200 is coupled to the photosensitive unit 100 to be rotatable to a development position (FIG. 3) in which the photosensitive drum 21 and the developing roller 22 contact each other to form the development nip N and a release position (FIG. 4) in which the photosensitive drum 21 and the developing roller 22 are separated from each other to release the development nip N. For example, the developing unit 200 is coupled to the photosensitive unit 100 to be rotatable to the development position and the release position with respect to a hinge shaft 301.

The development cartridge 2 further includes a pressurizing unit 400. The pressurizing unit 400 is installed at the photosensitive unit 100 and elastically presses the developing unit 200. A rotation direction of the developing unit 200 is determined according to a position of a portion pressed by the pressurizing unit 400. The developing unit 200 includes first and second pressing portions 221 and 222. The pressurizing unit 400 may move to a first position for pressing the first pressing portion 221 and a second position for pressing the second pressing portion 222. For example, the pressurizing unit 400 is mounted on a rotation shaft 302 provided in the photosensitive unit 100 to be rotatable to the first and second positions. The first position is a position for pressing the first pressing portion 221 and rotating the developing unit 200 with respect to the hinge shaft 301 in a first direction A1 for forming the development nip N, and the second position is a position for pressing the second pressing portion 222 and rotating the developing unit 200 with respect to the hinge shaft 301 in a second direction A2 for releasing the development nip N. The pressurizing unit 400 applies an elastic force in a direction of maintaining the developing unit 200 in the development position to the developing unit 200 at the first position and applies an elastic force in a direction of maintaining the developing unit 200 in the release position to the developing unit 200 at the second position.

The first pressing portion 221 is at an opposite side to that of the developing roller 22, based on a line L connecting the rotation shaft 302 and the hinge shaft 301 to each other, and the second pressing portion 222 is at the same side as the developing roller 22, based on the line L. A first stopper 221*a* prevents the pressurizing unit 400 from rotating beyond the first pressing portion 221. A second stopper 222*a* prevents the pressurizing unit 400 from rotating beyond the second pressing portion 222. A first position determiner 221*b* is at an opposite side to that of the first stopper 221*a* based on a rotation direction of the pressurizing unit 400 and maintains the pressurizing unit 400 in the first position. A second position determiner 222*b* is at an opposite side to that of the second stopper 222*a* based on the rotation direction of the pressurizing unit 400 and maintains the pressurizing unit 400 in the second position. While being elastically compressed towards the rotation shaft 302, the pressurizing unit 400 may rotate to the second position or the first position beyond the first and second position determiners 221*b* and 222*b*.

Figure 5:
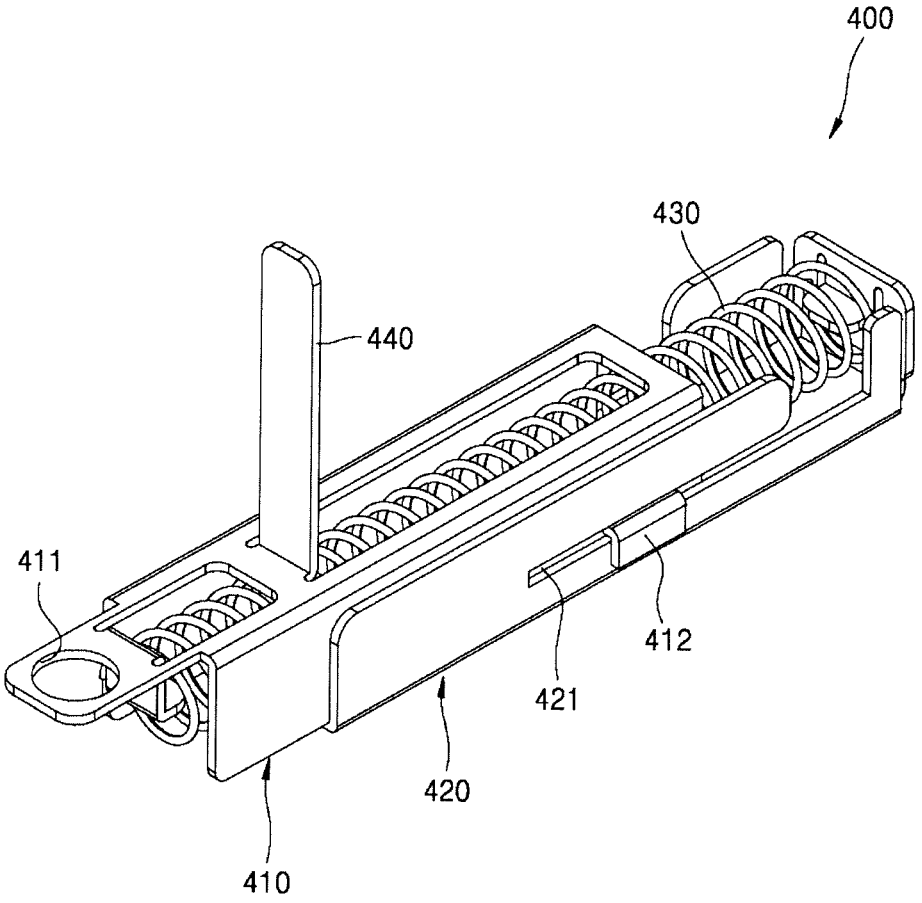
FIG. 5 is a schematic perspective view of a pressurizing unit illustrated in FIG. 2, according to an example.

FIG. 5 is a schematic perspective view of the pressurizing unit 400 according to an example. Referring to FIG. 5, the pressurizing unit 400 may include a rotation member 410, a pressing member 420 for pressing the first and second pressing portions 221 and 222, which is slidable on the rotation member 410, and an elastic member 430 for elastically biasing the pressing member 420 in a direction of pressing the first and second pressing portions 221 and 222. An end portion of the rotation member 410 includes a hinge hole 411 into which the rotation shaft 302 is inserted. The pressing member 420 is supported to be slidable on the rotation member 410 in a direction of accessing/being separated from the hinge hole 411. For example, the pressing member 420 includes a guide slot 421 extending in a sliding direction, and the rotation member 410 includes a guide protrusion 412 inserted into the guide slot 421. The elastic member 430 is between the rotation member 410 and the pressing member 420 and applies an elastic force to the pressing member 420 to slide in a direction far from the hinge hole 411. In the example, a compressive coil spring having one end and the other end respectively supported by the rotation member 410 and the pressing member 420 is used as the elastic member 430. However, a type and form of the elastic member 430 is not limited to the example illustrated in FIG. 5. A free field of the elastic member 430 is determined such that the pressing member 420 may elastically press the first and second pressing portions 221 and 222 when the pressurizing unit 400 is at the first and second positions.

A process of forming/releasing the development nip N through the above-described configuration will now be described in detail. A process of releasing the development nip N will be described first.

As illustrated in FIG. 3, in a state in which the pressurizing unit 400 is at the first position, the pressing member 420 contacts and pushes the first pressing portion 221. A direction of an elastic force applied to the first pressing portion 221 by the pressurizing unit 400 is a direction of forming the development nip N. That is, the developing unit 200 is elastically biased to rotate in the first direction A1 by an elastic force of the pressurizing unit 400 in the first position. The development nip N may be maintained in a formed state by the elastic force of the pressurizing unit 400.

When the pressurizing unit 400 is rotated from the first position to the second position, the pressing member 420 retreats in an opposite direction of the elastic force of the elastic member 430 and thus rotates to the second position beyond the first position determiner 221*b*. Until the pressurizing unit 400 reaches the line L (that is, until a direction of an elastic force applied to the developing unit 200 by the pressurizing unit 400 is aligned with that of the line L), the elastic force of the pressurizing unit 400 is maintained in a direction of forming the development nip N. That is, the elastic force of the pressurizing unit 400 works as a maintaining force maintaining the development nip N.

When the pressurizing unit 400 moves beyond the line L, the elastic force of the pressurizing unit 400 is shifted in a direction of releasing the development nip N. That is, the elastic force of the pressurizing unit 400 works as a releasing force releasing the development nip N. Accordingly, the developing unit 200 is rotated in the second direction A2 with respect to the hinge shaft 301 by the elastic force of the pressurizing unit 400, and the developing roller 22 is separated from the photosensitive drum 21 to release the development nip N.

When the pressurizing unit 400 reaches the second position beyond the second position determiner 222*b*, the pressing member 420 presses the second pressing portion 222, and the development nip N may be maintained in a released state by the elastic force of the pressurizing unit 400. An end portion of the pressing member 420 is obstructed by the second stopper 222*a*. Accordingly, the pressing member 400 does not rotate beyond the second pressing portion 222. In addition, the end portion of the pressing member 420 is obstructed by the second position determiner 222*b*. Accordingly, the pressurizing unit 400 is stably maintained in the second position.

Next, a process of forming the development nip N will be described.

As illustrated in FIG. 4, in a state in which the pressurizing unit 400 is at the second position, a direction of an elastic force applied to the second pressing portion 222 by the pressurizing unit 400 is a direction of releasing the development nip N. That is, the developing unit 200 is elastically biased to rotate in the second direction A2 by an elastic force of the pressurizing unit 400 in the second position. Accordingly, the development nip N may be maintained in a released state by the elastic force of the pressurizing unit 400.

When the pressurizing unit 400 is rotated from the second position to the first position, the pressing member 420 retreats in an opposite direction of the elastic force of the elastic member 430 and thus rotates to the first position beyond the second position determiner 222*b*. Until the pressurizing unit 400 reaches the line L, the elastic force of the pressurizing unit 400 is maintained in a direction of releasing the development nip N. That is, the elastic force of the pressurizing unit 400 works as a releasing force releasing the development nip N.

When the pressurizing unit 400 moves beyond the line L, the elastic force of the pressurizing unit 400 is shifted in a direction of forming the development nip N. That is, the elastic force of the pressurizing unit 400 works as a force forming the development nip N. Accordingly, the developing unit 200 is rotated in the first direction A1 with respect to the hinge shaft 301 by the elastic force of the pressurizing unit 400, and the developing roller 22 contacts the photosensitive drum 21 to form the development nip N.

When the pressurizing unit 400 reaches the first position beyond the first position determiner 221*b*, the pressing member 420 pushes the first pressing portion 221, and the development nip N may be maintained in a formed state by the elastic force of the pressurizing unit 400. An end portion of the pressing member 420 is obstructed by the first stopper 221*a*. Accordingly, the pressing member 400 does not rotate beyond the first pressing portion 221. In addition, the end portion of the pressing member 420 is obstructed by the first position determiner 221*b*. Accordingly, the pressurizing unit 400 is stably maintained in the first position.

As described above, when the pressurizing unit 400 is at the first position, the pressurizing unit 400 provides a maintaining force maintaining the development nip N to the developing unit 200. Until the pressurizing unit 400 reaches the line L from the first position, the maintaining force is continuously provided to the developing unit 200. Accordingly, in spite of external shock applied to an image forming apparatus or operation shock of an image forming apparatus, the development nip N may be stably maintained in a formed state, and thus, stable image quality may be obtained.

When the pressurizing unit 400 is at the second position, the pressurizing unit 400 provides a releasing force releasing the development nip N to the developing unit 200. Until the pressurizing unit 400 reaches the line L from the second position, the releasing force is continuously provided to the developing unit 200. Accordingly, the development nip N may be stably maintained in a released state even during a process of providing the development cartridge 2 for manufacture, transport, and sales, and thus, deformation or destruction of the developing roller 22 and/or the photosensitive drum 21 may be reduced.

In addition, a function of forming/releasing the development nip N as a development nip control member and a function of providing an elastic force maintaining the development nip N as an elastic member are integrated in the pressurizing unit 400. Accordingly, the development nip N may be controlled and maintained through a simple structure.

When the pressurizing unit 400 is shifted from the first position to the second position or from the second position to the first position, a direction of an elastic force may change from a maintaining force to a releasing force or reversely. Accordingly, reliability of an operation of forming/releasing the development nip N may improve.

Through the above-described configuration, by moving the pressurizing unit 400 provided in the development cartridge 2 itself to the first and second positions, the development nip N may be easily formed/released.

The pressurizing unit 400 may be shifted from the second position to the first position by an operation of mounting the development cartridge 2 in the main body 1.

Referring to FIG. 5, the pressurizing unit 400 includes an interference lever 440. For example, the interference lever 440 may extend from the rotation member 410. In the example, the interference lever 440, for example, extends from the rotation member 410 and protrudes from a side portion of the development cartridge 2.

Figure 6:
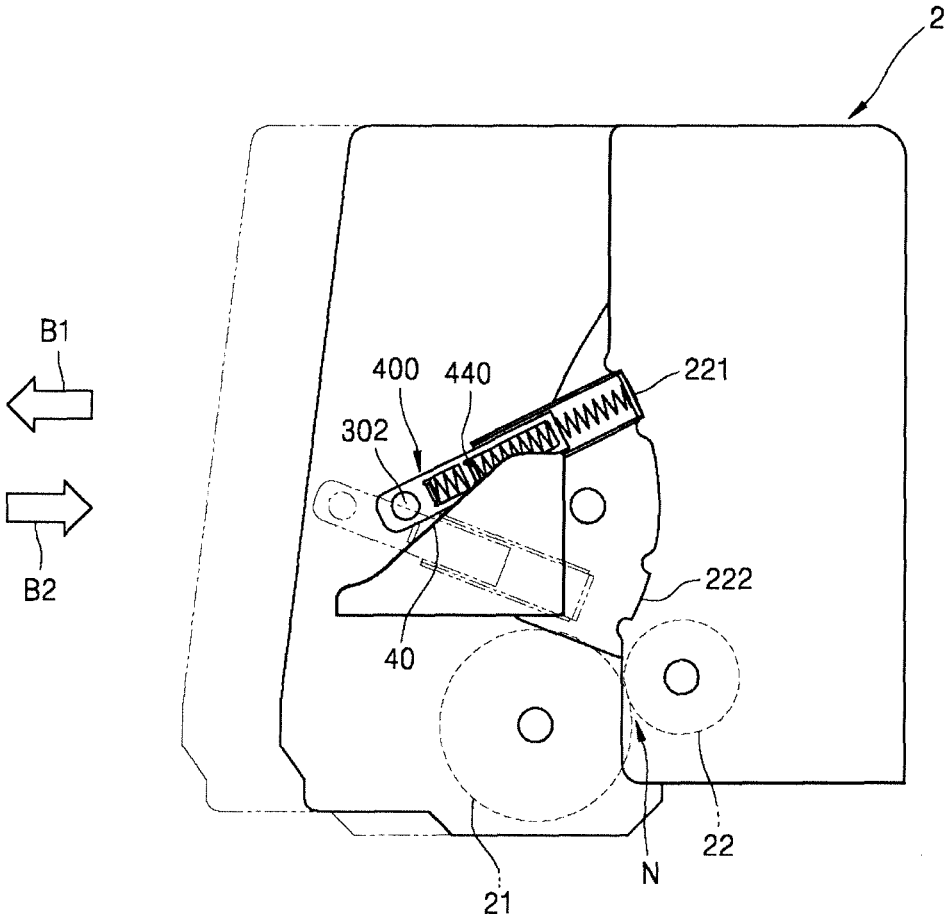
FIG. 6 is a schematic diagram illustrating a structure in which a development nip is formed in conjunction with an operation of mounting a development cartridge on a main body, according to an example.

FIG. 6 is a schematic diagram illustrating a structure in which the development nip N is formed in conjunction with an operation of mounting the development cartridge 2 on the main body 1, according to an example. Referring to FIG. 6, the development cartridge 2 is moved in the mounting direction B1 to be mounted on the main body 1. The main body 1 includes an operating portion 40 interfering with the interference lever 440. The operating portion 40 has a structure capable of, when the development cartridge 2 is mounted on the main body 1, interfering with the interference lever 440 and rotating the pressurizing unit 400 in the second position to the first position. For example, the operating portion 40 may be inclined upwards in the mounting direction B1.

As denoted by dashed lines in FIG. 6, when the development cartridge 2 is mounted on the main body 1 in a state in which the pressurizing unit 400 is at the second position, the interference lever 440 interferes with the operating portion 40. When the development cartridge 2 is pushed in the mounting direction B1 in this state, the interference lever 440 is guided by the operating portion 40, and the pressurizing unit 400 is rotated from the second position to the first position with respect to the rotation shaft 302. Accordingly, the development nip N may be formed.

When the development cartridge 2 is detached from the main body 1, the pressurizing unit 400 is maintained in the first position. Accordingly, if necessary, the development nip N may be released by rotating the pressurizing unit 400 to the second position manually.

Figure 7:
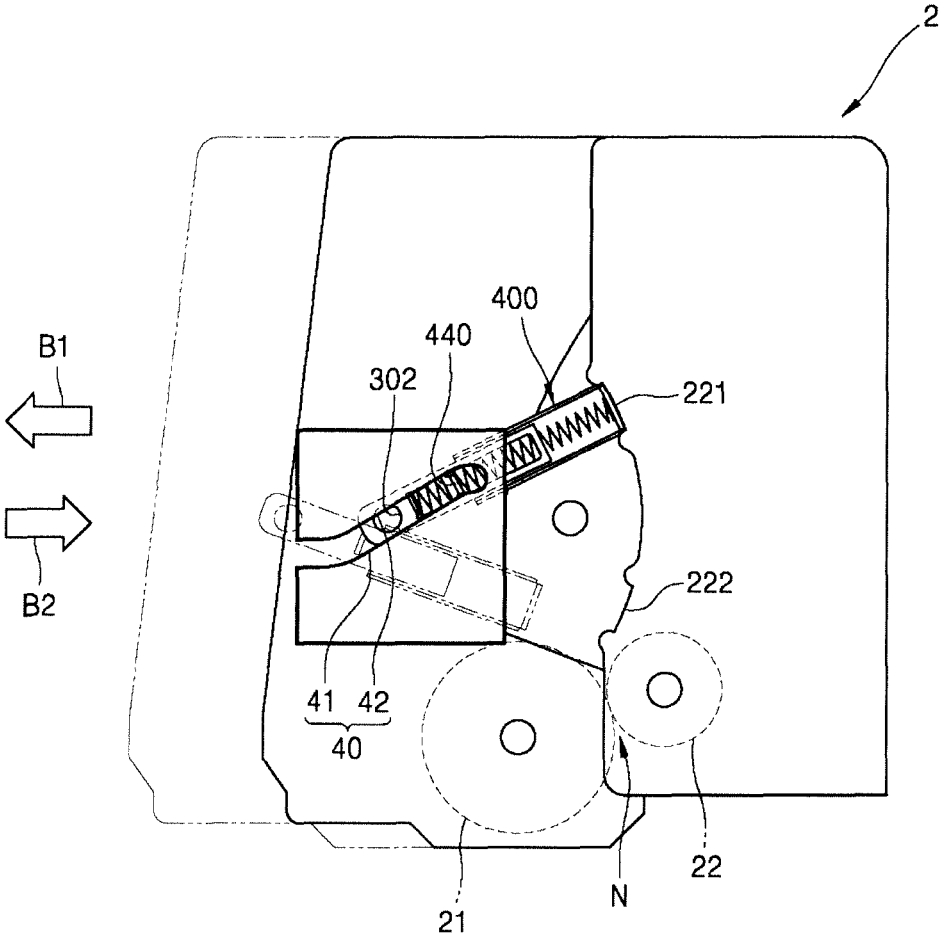
FIG. 7 is a schematic diagram illustrating a structure in which a development nip is released in conjunction with an operation of detaching a development cartridge from a main body, according to an example.

The pressurizing unit 400 may be shifted from the first position to the second position by an operation of detaching the development cartridge 2 from the main body 1. FIG. 7 is a schematic diagram illustrating a structure in which the development nip N is released in conjunction with an operation of detaching the development cartridge 2 from the main body 1, according to an example. Referring to FIG. 7, the operating portion 40 includes a first operating portion 41 and a second operating portion 42. When the development cartridge 2 is mounted on the main body 1, the first operating portion 41 interferes with the interference lever 440 and thus guides the pressurizing unit 400 from the second position to the first position. When the development cartridge 2 is detached from the main body 1, the second operating portion 42 interferes with the interference lever 440 and thus guides the pressurizing unit 400 from the first position to the second position. As an example, the operating portion 40 may be in a form of a slot formed to insert therein and guide the interference lever 440. The slot may be generally inclined upwards in the mounting direction B1. For example, in FIG. 7, a lower wall of the slot serves as the first operating portion 41, and an upper wall thereof serves as the second operating portion 42.

Through the above-described configuration, when the development cartridge 2 is pushed in the mounting direction B1 and mounted on the main body 1 in a state in which the pressurizing unit 400 is at the second position, the interference lever 440 is guided by the first operating portion 41, and the pressurizing unit 400 is rotated from the second position to the first position. When the development cartridge 2 is pulled in the removal direction B2 and detached from the main body 1, the interference lever 440 is guided by the second operating portion 42, and the pressurizing unit 400 is rotated from the first position to the second position.

Figure 8:
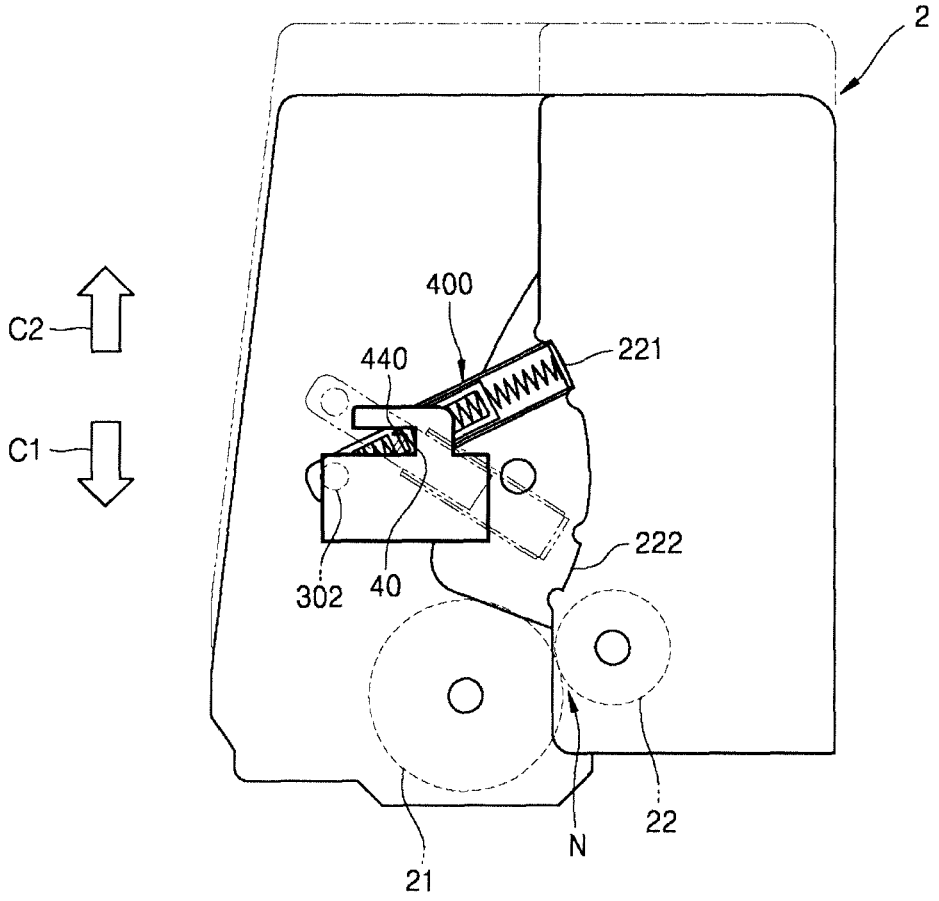
FIG. 8 is a schematic diagram illustrating a structure in which a development nip is formed/released in conjunction with descending/ascending operations of a tray, according to an example.

As illustrated in FIG. 2, the development cartridge 2 may be loaded on the tray 1 and be mounted on the main body 1. In this case, the pressurizing unit 400 may be shifted to the first position and the second position by an operation in which the tray 1 descends/ascends with respect to the intermediate transfer belt 31. FIG. 8 is a schematic diagram illustrating a structure in which the development nip N is formed/released in conjunction with descending/ascending operations of the tray 5, according to an example. Referring to FIG. 8, the operating portion 40 provided in the main body 1 is in a form of a slot in which a side portion thereof in the removal direction B2 is open. When the tray 5 loaded with the development cartridge 2 slides into the main body 1 in the mounting direction B1, the interference lever 440 is inserted into the operating portion 40 in the form of a slot. In this state, for example, when the door 12 is closed, the tray 5 moves in the descending direction C1. Since the interference lever 440 is engaged with the operating portion 40, the pressurizing unit 400 is rotated from the second position to the first position as the tray 5 moves in the descending direction C1, and the development nip N is formed.

To detach the development cartridge 2, when the door 12 is opened, the tray 5 moves in the ascending direction C2. Thus, the pressurizing unit 400 is rotated from the first position to the second position, and the development nip N is released. In this state, by pulling the tray 5 in the removal direction B2, the tray 5 may be withdrawn from the main body 1 as illustrated in FIG. 2 to lift and bring the development cartridge 2 out of the tray 5.

Figure 9:
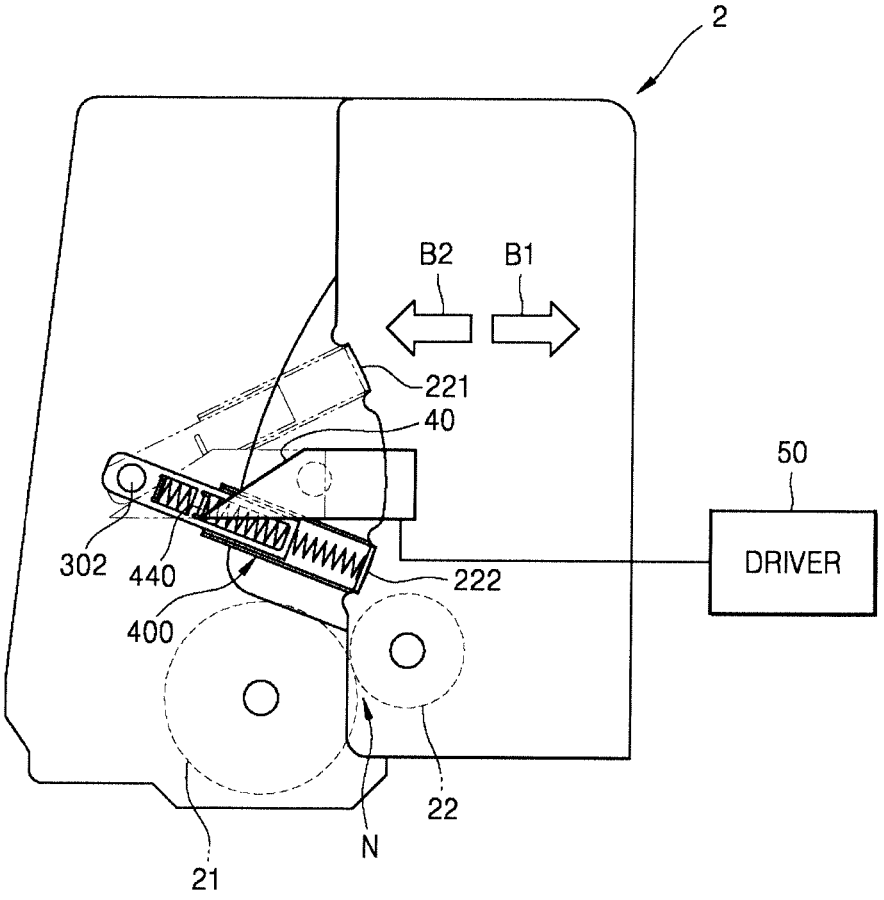
FIG. 9 is a schematic configuration diagram illustrating an image forming apparatus according to an example.

A structure in which the development cartridge 2 is mounted on the main body 1 and then the operating portion 40 is moved in the mounting direction B1 or the removal direction B2 to rotate the pressurizing unit 400 to the first and second positions may also be employed. FIG. 9 is a schematic configuration diagram illustrating an image forming apparatus according to an example. Referring to FIG. 9, the main body 1 includes the operating portion 40 interfering with the interference lever 440. For example, the operating portion 40 has a structure capable of, while moving in the removal direction B2, interfering with the interference lever 440 and rotating the pressurizing unit 400 in the second position to the first position. For example, the operating portion 40 may be inclined upwards in the mounting direction B1. Through the above-described configuration, as denoted by solid lines in FIG. 9, after the development cartridge 2 is mounted on the main body 1 in a state in which the pressurizing unit 400 is at the second position, as denoted by dash-double dotted lines in FIG. 9, while the operating portion 40 is moved in the removal direction B2, the pressurizing unit 400 may be rotated from the second position to the first position. The mounting portion 40 may be moved in conjunction with a closing operation of the door 12, and may be moved by a driver 50. The driver 50 may be implemented, for example, by a linear motor, a solenoid actuator, or a rotary motor and a converter for converting rotary movement of the rotary motor into reciprocal movement of the operating portion 40.

Figure 10:
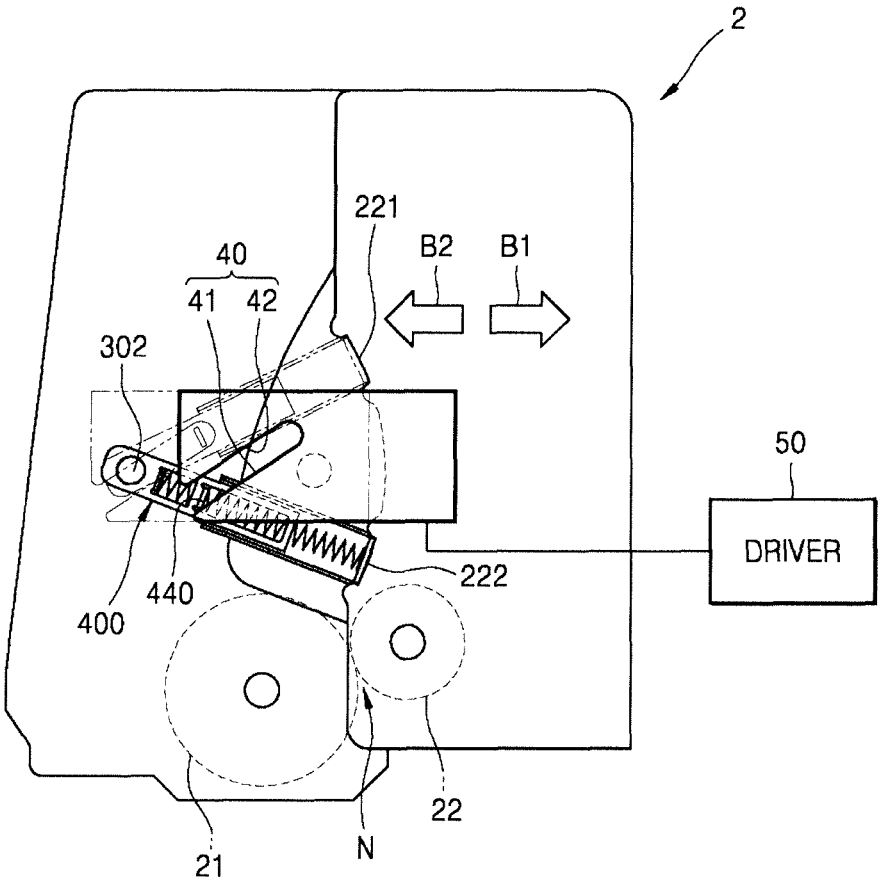
FIG. 10 is a schematic configuration diagram illustrating an image forming apparatus according to an example.

FIG. 10 is a schematic configuration diagram illustrating an image forming apparatus according to an example. Referring to FIG. 10, the operating portion 40 includes the first operating portion 41 and the second operating portion 42. When the operating portion 40 moves in the removal direction B2, the first operating portion 41 interferes with the interference lever 440 and thus guides the pressurizing unit 400 from the second position to the first position. When the operating portion 40 moves in the mounting direction B1, the second operating portion 42 interferes with the interference lever 440 and thus guides the pressurizing unit 400 from the first position to the second position. As an example, the operating portion 40 may be in a form of a slot formed to insert therein and guide the interference lever 440. The slot may be generally inclined upwards in the mounting direction B1. In FIG. 10, a lower wall of the slot serves as the first operating portion 41, and an upper wall of the slot serves as the second operating portion 42.

Through the above-described configuration, as denoted by solid lines in FIG. 10, after the development cartridge 2 is pushed in the mounting direction B1 and mounted on the main body 1 in a state in which the pressurizing unit 400 is at the second position, as denoted by dash-double dotted lines in FIG. 10, when the operating portion 40 is moved in the removal direction B2, the interference lever 440 is guided by the first operating portion 41, and the pressurizing unit 400 is rotated from the second position to the first position. When the operating portion 40 is moved in the mounting direction B1, the interference lever 440 is guided by the second operating portion 42, and the pressurizing unit 400 is rotated from the first position to the second position. The mounting portion 40 may be moved in conjunction with a closing operation of the door 12, and may be moved by the driver 50. The driver 50 may be implemented, for example, by a linear motor, a solenoid actuator, or a rotary motor and a converter for converting rotary movement of the rotary motor into reciprocal movement of the operating portion 40.

In the above-described examples, a structure in which the developing unit 200 is coupled to the photosensitive unit 100 to be rotatable to a development position where the development nip N is formed and a release position where the development nip N is released with respect to the hinge shaft 301 has been described. However, a coupling form of the developing unit 200 and the photosensitive unit 100 is not limited thereto.

Figure 11:
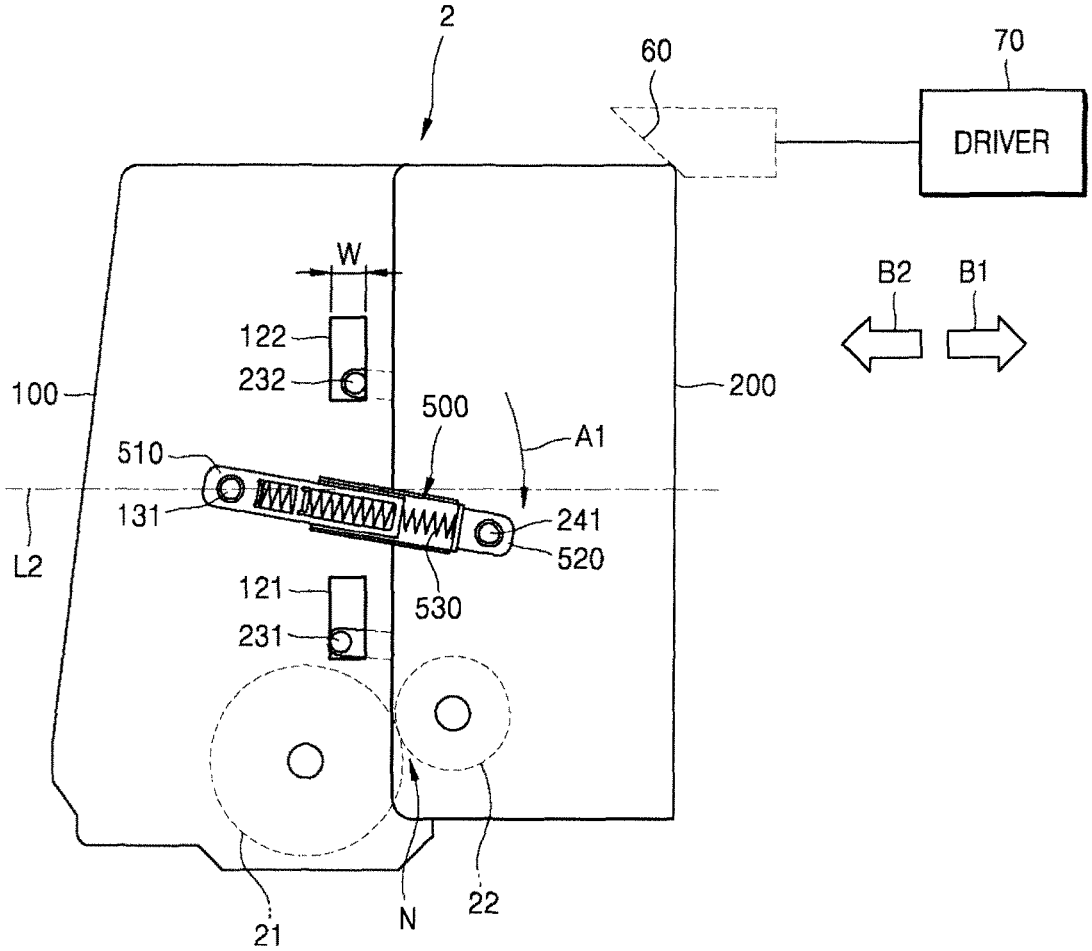
FIG. 11 is a schematic configuration diagram of an image forming apparatus according to an example, which illustrates a state in which a developing unit is in a development position.
Figure 12:
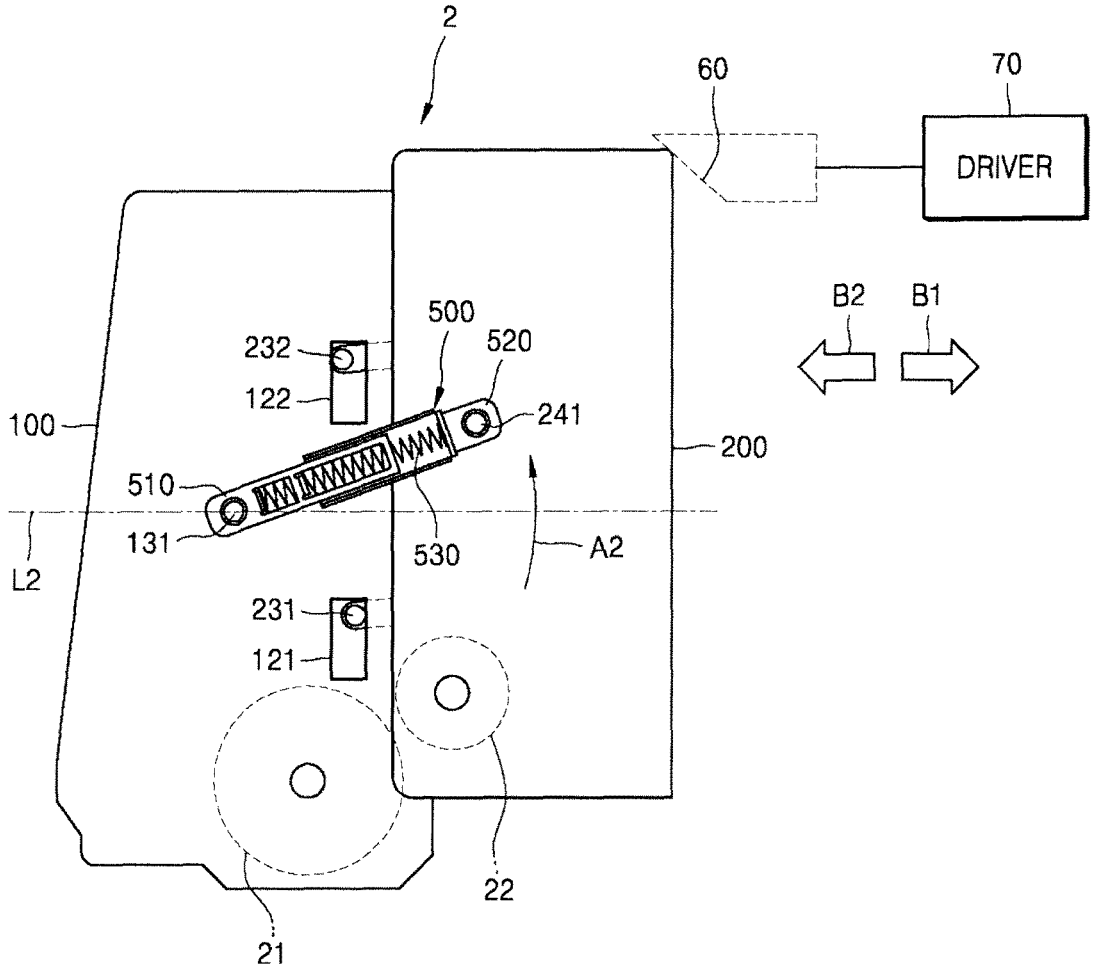
FIG. 12 is a schematic configuration diagram of an image forming apparatus according to an example, which illustrates a state in which a developing unit is in a release position.
Figure 13:
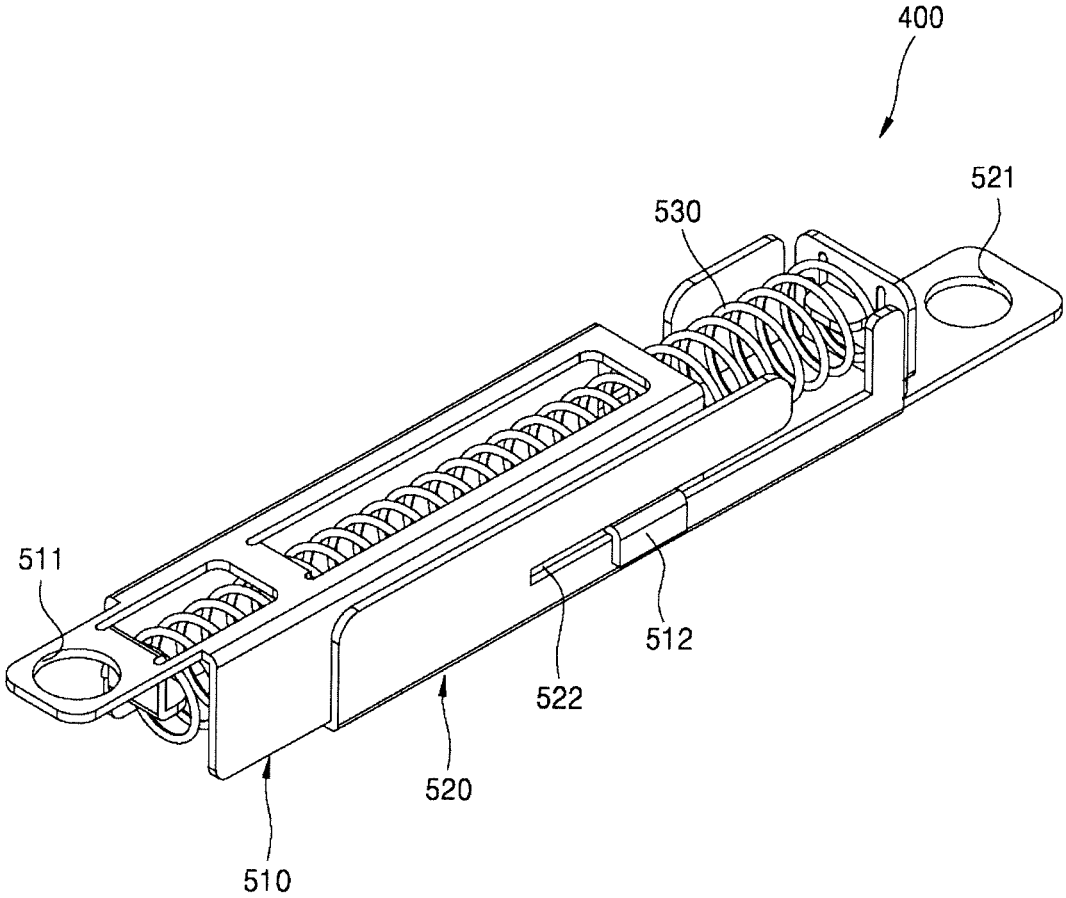
FIG. 13 is a perspective view of a pressurizing unit illustrated in FIG. 12, according to an example.

As an example, the developing unit 200 may be coupled to the photosensitive unit 100 to be slidable to a development position where the development nip N is formed and a release position where the development nip N is released. FIGS. 11 and 12 each are schematic configuration diagrams of an image forming apparatus according to an example, in which FIG. 11 illustrates a state in which the developing unit 200 is in a development position, and FIG. 12 illustrates a state in which the developing unit 200 is in a release position. FIG. 13 is a perspective view of a pressurizing unit 500 according to an example.

Referring to FIGS. 11 and 12, the developing unit 200 is coupled to the photosensitive unit 100 to be slidable to a development position (FIG. 11) where the photosensitive drum 21 and the developing roller 22 contact each other to form the development nip N and a release position (FIG. 12) where the photosensitive drum 21 and the developing roller 22 are separated from each other to release the development nip N. For example, the photosensitive unit 100 includes first and second guide slots 121 and 122, and the developing unit 200 includes first and second guide protrusions 231 and 232 respectively inserted into the first and second guide slots 121 and 122. The first and second guide slots 121 and 122 extend in a sliding direction of the developing unit 200 and are separate from each other in the sliding direction. A width W of the first and second guide slots 121 and 122 in a direction perpendicular to the sliding direction is a little greater than a width, for example, a diameter, of the first and second guide protrusions 231 and 232. Thus, the developing unit 200 may slide along the first and second guide slots 121 and 122, and at the same time, may rotate slightly.

The development cartridge 2 further includes the pressurizing unit 500. Referring to FIG. 13, the pressurizing unit 500 may include a first rotation member 510, a second rotation member 520, and an elastic member 530. The first rotation member 510 includes a first hinge hole 511 into which a first rotation shaft 131 provided in the photosensitive unit 100 is inserted, such that the first rotation member 510 may rotate around the first rotation shaft 131 via the first hinge hole 511. The second rotation member 520 includes a second hinge hole 521 into which a second rotation shaft 241 provided in the developing unit 200 is inserted, such that the second rotation member 520 may rotate around the second rotation shaft 241 via the second hinge hole 521. The first and second rotation members 510 and 520 are elastically slidably connected between the first and second rotation shafts 131 and 241. For example, the second rotation member 520 includes a guide slot 451 extending in a sliding direction, and the second rotation member 510 includes a guide protrusion 512 inserted into the guide slot 521. The elastic member 530 is between the first and second rotation members 510 and 520 and applies an elastic force to allow the first and second rotation members 510 and 520 to slide in a direction far from each other. In the example, a compressive coil spring having one end and the other end respectively supported by the first rotation member 510 and the second rotation member 520 is used as the elastic member 430. However, a type and form of the elastic member 530 is not limited to the example illustrated in FIG. 13. For example, various forms of members such as a torsion coil spring and a plate spring may be used as the elastic member 530. Through the above-described configuration, the pressurizing unit 500 may have one end portion rotatably connected to the first rotation shaft 131 and the other end portion rotatably connected to the second rotation shaft 241.

The pressurizing unit 500 has a first position (FIG. 11) where an elastic force is applied to the developing unit 200 to slide in a direction of forming the development nip N and a second position (FIG. 12) where an elastic force is applied to the developing unit 200 to slide in a direction of releasing the development nip N. At the first position, the developing unit 200 is in the development position, and at the second position, the developing unit 200 is in the release position. Based on a line L2 passing through the first rotation shaft 131 and perpendicular to an extending direction of the first and second guide slots 121 and 122, that is, a sliding direction of the developing unit 200, the second rotation shaft 241 is at the same side as the developing roller 22 at the first position and is at an opposite side thereof at the second position. Through the above-described configuration, elastic forces of the pressurizing unit 500 applied when the pressurizing unit 500 is at the first and second positions respectively work in a direction of forming and maintaining the development nip N and in a direction of releasing the development nip N.

A process of forming/releasing the development nip N through the above-described configuration will now be described in detail. A process of releasing the development nip N is described first.

As illustrated in FIG. 11, in a state in which the pressurizing unit 500 is at the first position, an elastic force of the pressurizing unit 500 is applied in a direction of causing the developing unit 200 to slide downwards. In addition, there is a gap between the first and second guide slots 121 and 122 and the first and second guide protrusions 231 and 232, and thus, the elastic force of the pressurizing unit 500 is also applied in a direction of rotating the developing unit 200 in the first direction A1. Accordingly, the development nip N may be maintained in a formed state by the elastic force of the pressurizing unit 500.

When the developing unit 200 slides in a direction in which the developing roller 22 is separated from the photosensitive drum 21 from a state illustrated in FIG. 11 to a state illustrated in FIG. 12, the pressurizing unit 500 rotates on the first and second rotation shafts 131 and 241. Until the pressurizing unit 500 lies parallel to the line L2 (that is, until a direction of an elastic force applied to the developing unit 200 by the pressurizing unit 500 is aligned with that of the line L2), the elastic force of the pressurizing unit 500 is maintained in a direction of forming the development nip N. That is, the elastic force of the pressurizing unit 500 works as a maintaining force maintaining the development nip N in a formed state.

When the pressurizing unit 500 is rotated beyond the line L2 by causing the developing unit 200 to further slide, a direction of the elastic force of the pressurizing unit 500 is shifted to a direction of releasing the development nip N. That is, the elastic force of the pressurizing unit 500 works as a releasing force releasing the development nip N. Accordingly, due to the elastic force of the pressurizing unit 500, the developing unit 200 further slides in the direction in which the developing roller 22 is separated from the photosensitive drum 21.

When the pressurizing unit 500 reaches the second position, the developing unit 200 may be elastically biased in a direction of rotating in the second direction A2 by the elastic force of the pressurizing unit 500, and the development nip N may be maintained in a released state.

Next, a process of forming the development nip N will be described.

As illustrated in FIG. 12, in a state in which the pressurizing unit 500 is at the second position, a direction of an elastic force applied to the developing unit 200 by the pressurizing unit 500 is a direction of releasing the development nip N.

When the developing unit 200 slides in a direction in which the developing roller 21 approaches the photosensitive drum 21, the elastic force of the pressurizing unit 500 is maintained in the direction of releasing the development nip N until the pressurizing unit 500 rotates and reaches the line L2.

When the developing unit 200 further slides, and thus, the pressurizing unit 500 rotates beyond the line L2, the direction of the elastic force of the pressurizing unit 500 is shifted to a direction of causing the developing unit 200 to slide in the direction in which the developing roller 22 approaches the photosensitive drum 21. Accordingly, due to the elastic force of the pressurizing unit 500, the developing unit 200 more easily slides in the direction in which the developing roller 22 approaches the photosensitive drum 21.

When the pressurizing unit 500 reaches the first position, the developing roller 22 may contact the photosensitive drum 21 to form the development nip N as illustrated in FIG. 11, and the development nip N may be maintained in a formed state by the elastic force of the pressurizing unit 500. As described above, there is a gap between the first and second guide slots 121 and 122 and the first and second guide protrusions 231 and 232, and thus, the developing unit 200 is elastically biased in a direction of rotating in the first direction A1 by the elastic force of the pressurizing unit 500.

Through the above-described configuration, the pressurizing unit 500 provided in the development cartridge 2 itself may be shifted to the first and second positions by causing the developing unit 200 to slide with respect to the photosensitive unit 100, and thus, the development nip N may be easily formed/released.

In the above-described example, a structure in which the photosensitive unit 100 includes first and second guide slots and the developing unit 200 includes first and second guide protrusions is employed. However, a structure in which the developing unit 200 includes first and second guide slots and the photosensitive unit 100 includes first and second guide protrusions may also be employed. The number of each of a guide slot and a guide protrusion is not limited to 2, and three or more may be provided. When three guide slots are provided, the three guide slots may each extend in a sliding direction of the developing unit 200 and may be generally arranged in a triangle form.

The pressurizing unit 500 may be shifted from the second position to the first position by an operation of mounting the development cartridge 2 on the main body 1. For example, as denoted by dashed lines in FIGS. 11 and 12, the main body 1 includes an operating portion 60 interfering with the developing unit 200. Referring to FIG. 12, when the development cartridge 2 is mounted on the main body 1, the operating portion 60 interferes with the developing unit 200 positioned in a release position and thus guides the developing unit 200 to move in a direction in which the developing roller 22 approaches the photosensitive drum 21. For example, the operating portion 60 may be inclined downwards in the mounting direction B1. When the development cartridge 2 is mounted on the main body 1 in a state in which the pressurizing unit 500 is at the second position, the developing unit 200 is guided by the operating portion 60 to move in the direction in which the developing roller 22 approaches the photosensitive drum 21, and the pressurizing unit 500 is rotated from the second position to the first position with respect to the first and second rotation shafts 131 and 241. When the pressurizing unit 500 reaches the first position as illustrated in FIG. 11, the development nip N is formed.

When the development cartridge 2 is detached from the main body 1, the pressurizing unit 500 is maintained in the first position. Accordingly, if necessary, the pressurizing unit 500 may be rotated to the second position manually by causing the developing unit 200 to slide, and thus, the development nip N may be released.

Figure 14:
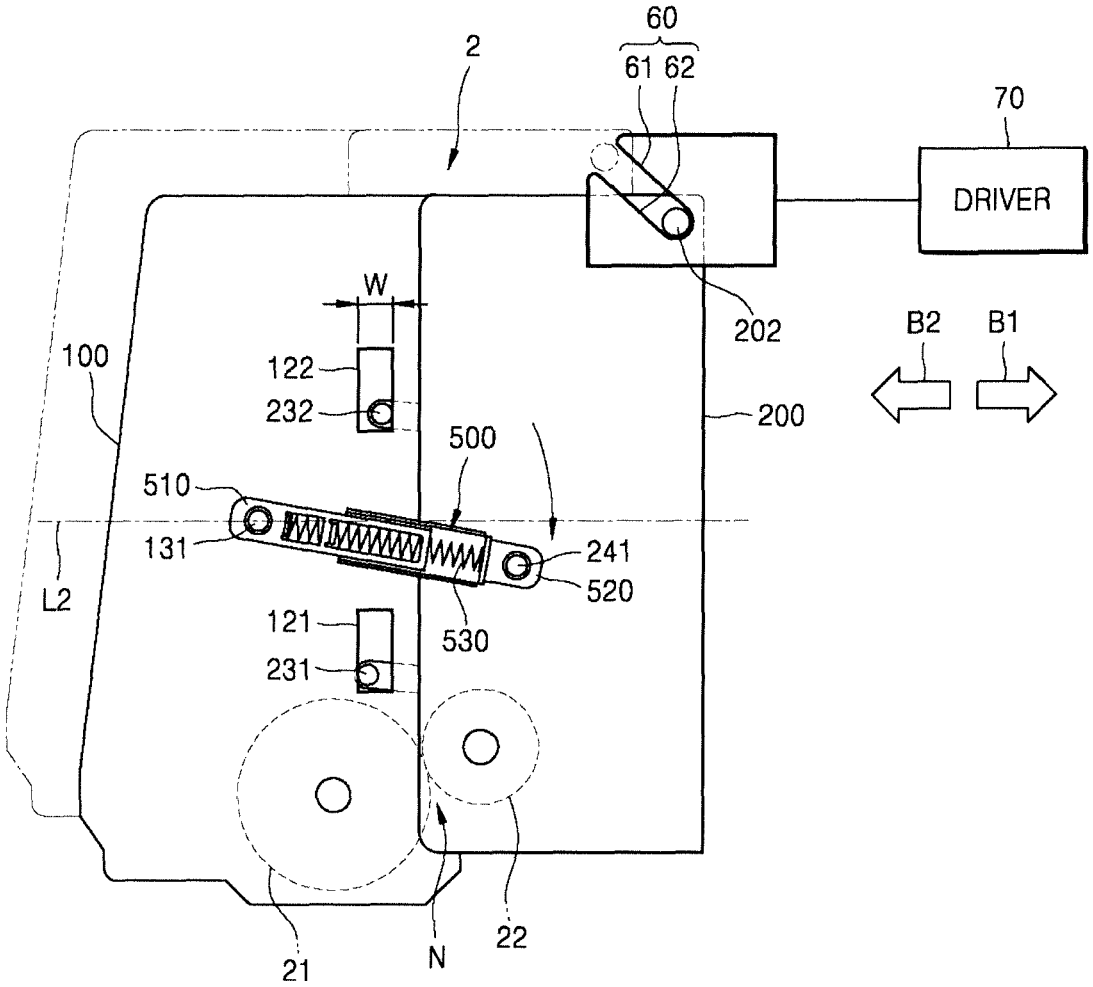
FIG. 14 is a schematic diagram illustrating a structure in which a development nip is released in conjunction with an operation of detaching a development cartridge from a main body, according to an example.

The pressurizing unit 500 may be shifted from the first position to the second position by an operation of detaching the development cartridge 2 from the main body 1. FIG. 14 is a schematic diagram illustrating a structure in which the development nip N is released in conjunction with an operation of detaching the development cartridge 2 from the main body 1, according to an example. Referring to FIG. 14, the operating portion 60 includes a first operating portion 61 and a second operating portion 62. When the development cartridge 2 is mounted on the main body 1, the first operating portion 61 guides the developing unit 200 to slide in a direction in which the developing roller 22 approaches the photosensitive drum 21. Thus, the pressurizing unit 500 may be shifted from the second position to the first position. When the development cartridge 2 is detached from the main body 1, the second operating portion 62 guides the developing unit 200 to slide in a direction in which the developing roller 22 is separated from the photosensitive drum 21. Thus, the pressurizing unit 500 may be shifted from the first position to the second position. As an example, the operating portion 60 may be in a form of a slot formed to insert therein a guide boss 202 provided in the developing unit 200 and guide the guide boss 202. The slot may be generally inclined downwards in the mounting direction B1. In FIG. 14, an upper wall of the slot serves as the first operating portion 61, and a lower wall of the slot serves as the second operating portion 62.

Through the above configuration, when the development cartridge 2 is pushed in the mounting direction B1 and mounted on the main body 1 in a state in which the pressurizing unit 500 is at the second position, the pressurizing unit 500 is rotated from the second position to the first position by sliding of the developing unit 200 guided by the first operating portion 61. When the development cartridge 2 is pulled in the removal direction B2 and detached from the main body 1, the pressurizing unit 500 is rotated from the first position to the second position by sliding of the developing unit 200 guided by the second operating portion 62.

A structure in which the development cartridge 2 is mounted on the main body 1 and then the operating portion 60 is moved in the mounting direction B1 or the removal direction B2 to rotate the pressurizing unit 500 to the first and second positions may also be employed. Referring to FIGS. 11 and 12, for example, the operating portion 60 has a structure capable of, while moving in the removal direction B2, interfering with the developing unit 200 and causing the developing unit 200 to slide, thereby rotating the pressurizing unit 500 in the second position to the first position. For example, the operating portion 50 may be inclined downwards in the mounting direction B1. Through the above-described configuration, after the development cartridge 2 is mounted on the main body 1 in a state in which the pressurizing unit 500 is at the second position, the pressurizing unit 500 may be rotated from the second position to the first position while the operating portion 60 is moved in the removal direction B2. The mounting portion 50 may be moved in conjunction with a closing operation of the door 12, and may be moved by a driver 70. The driver 70 may be implemented, for example, by a linear motor, a solenoid actuator, or a rotary motor and a converter for converting rotary movement of the rotary motor into reciprocal movement of the operating portion 40.

The driver 70 may be used to drive the operating portion 60 illustrated in FIG. 14. Referring to FIG. 14, the operating portion 60 may be in a form of a slot formed to insert therein and guide the guide boss 202. The slot may be generally inclined downwards in the mounting direction B1. A lower wall of the slot serves as the first operating portion 41, and an upper wall of the slot serves as the second operating portion 42. Through the above configuration, when the development cartridge 2 is pushed in the mounting direction B1 and mounted on the main body 1 in a state in which the pressurizing unit 500 is at the second position, and then, the operating portion 60 is moved in the removal direction B2, the developing unit 200 is guided by the first operating portion 61 and slides, and the pressurizing unit 500 is rotated from the second position to the first position. When the operating portion 60 is moved in the mounting direction B1, the developing unit 200 is guided by the second operating portion 62 and slides, and the pressurizing unit 500 is rotated from the first position to the second position. The mounting portion 60 may be moved in conjunction with a closing operation of the door 12, and may be moved by the driver 70. The driver 70 may be implemented, for example, by a linear motor, a solenoid actuator, or a rotary motor and a converter for converting rotary movement of the rotary motor into reciprocal movement of the operating portion 40.

Figure 15:
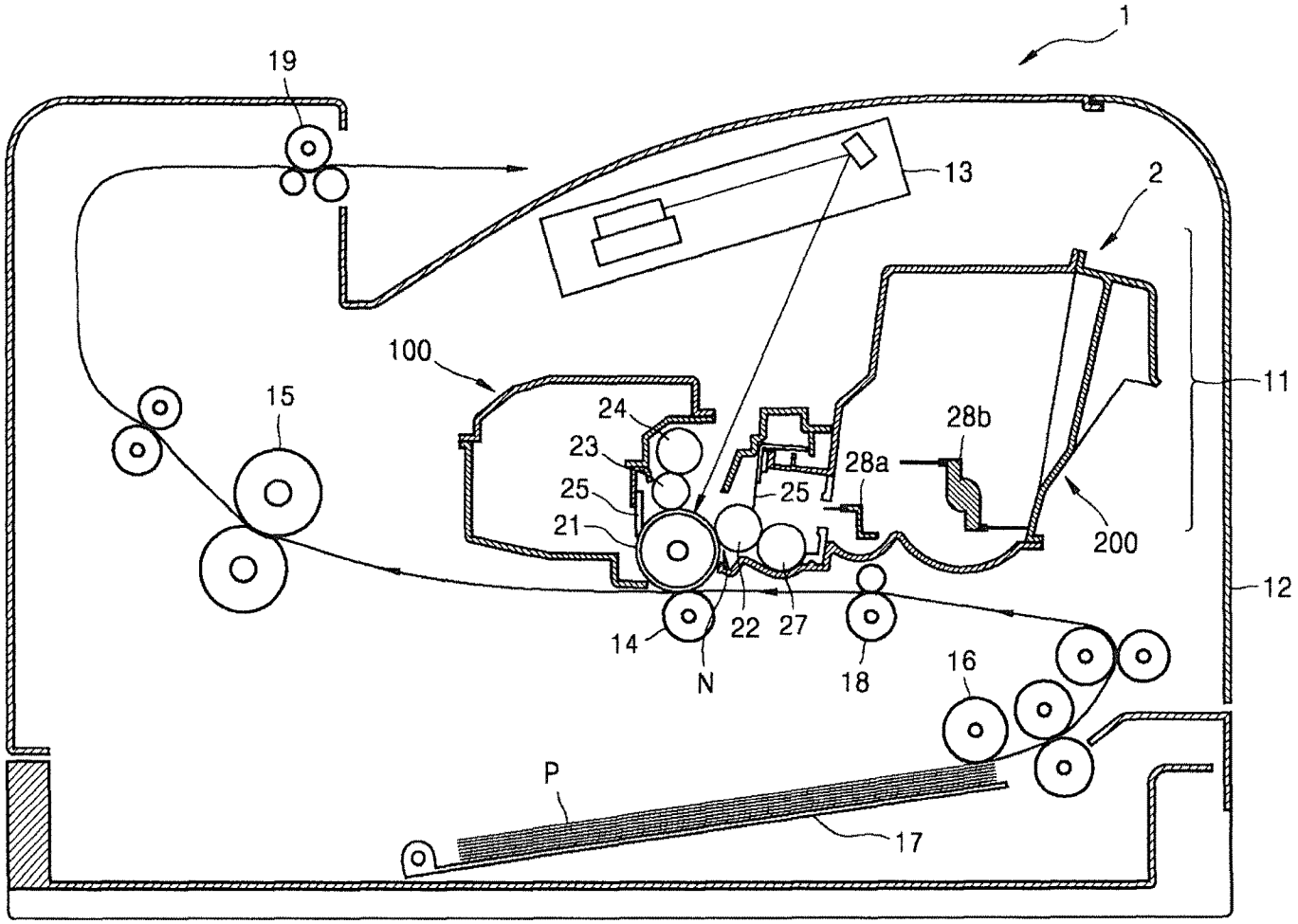
FIG. 15 is a schematic configuration diagram illustrating an electrophotographic image forming apparatus according to an example.

FIG. 15 is a schematic configuration diagram illustrating an electrophotographic image forming apparatus according to an example. The electrophotographic image forming apparatus according to the example is a single-color image forming apparatus. In FIG. 15, elements performing the same functions as those of the image forming apparatus illustrated in FIG. 1 are denoted by the same reference numerals, and a repeated description thereof is omitted.

The development cartridge 2 includes the photosensitive unit 100 and the developing unit 200. The photosensitive unit 100 includes the photosensitive drum 21 and the charging roller 23. Reference numeral 24 denotes a cleaning roller for removing foreign substances attached on the charging roller 23. The developing unit 200 includes the developing roller 22 and the supply roller 27. First and second agitators 28*a* and 28*b* for stirring toner and carrying toner to the supply roller 27 may be arranged in the toner container 201. Reference numeral 25 denotes a regulating member for regulating an amount of toner which is attached to the developing roller 22 and is supplied to the development nip N.

A transfer roller 14 faces the photosensitive drum 1, and the recording medium P is transported between the photosensitive drum 21 and the transfer roller 14.

Through the above-described configuration, the exposure device 13 forms an electrostatic latent image by scanning light modulated according to image information to the photosensitive drum 21. The developing roller 22 forms a visible toner image on a surface of the photosensitive drum 21 by supplying toner to the electrostatic latent image. The recording medium P loaded on the loading plate 17 is transported to an area where the photosensitive drum 21 and the transfer roller 14 face each other by the pick-up roller 16 and the feed roller 18, and the toner image is transferred from the photosensitive drum 21 to the recording medium P by a transfer bias voltage applied to the transfer roller 14. When the recording medium P passes through the fuser 15, the toner image is fixed on the recording medium P due to heat and pressure. The recording medium P on which fixing has been completed is discharged by the discharge roller 19.

Figure 16:
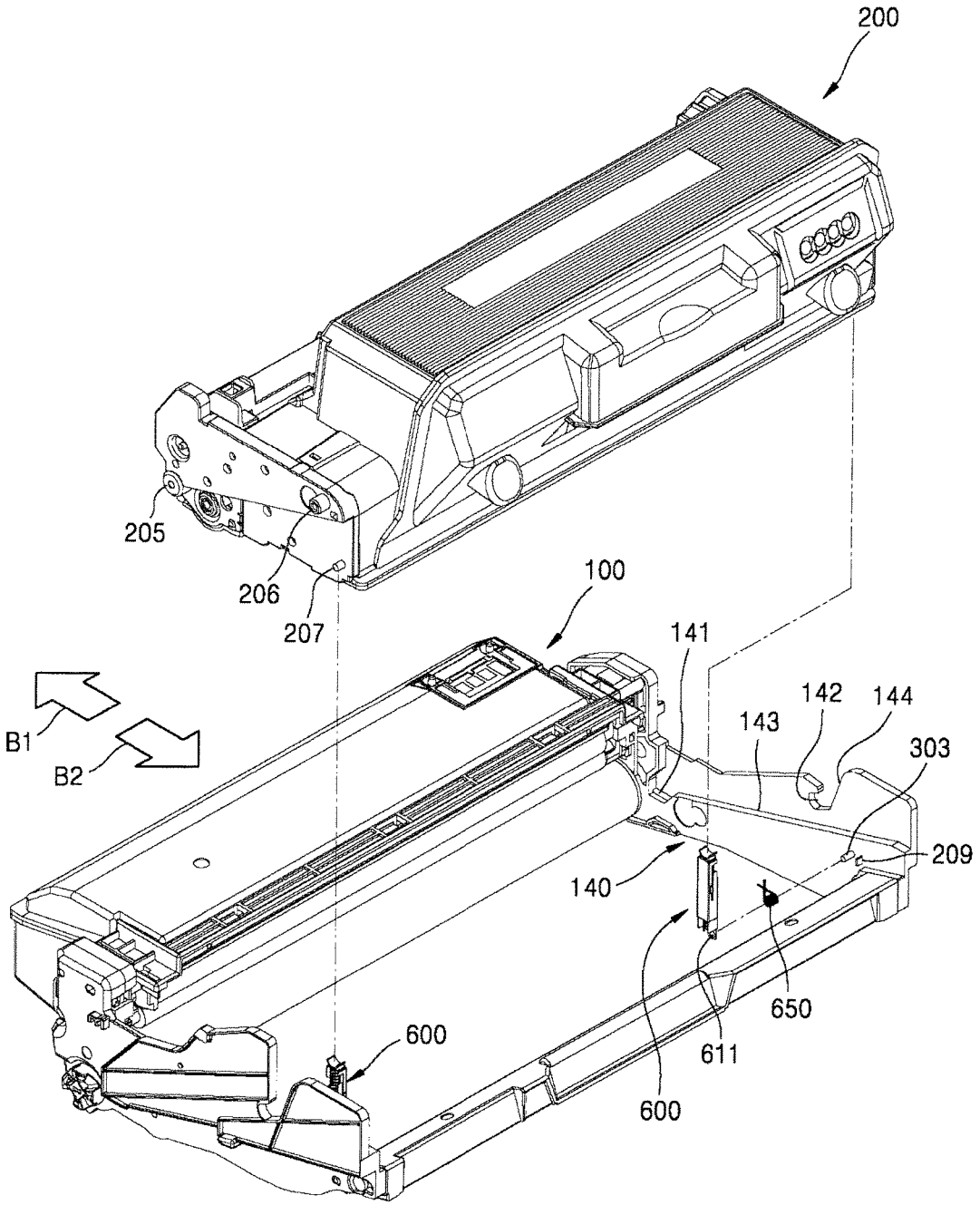
FIG. 16 is an exploded perspective view of a development cartridge illustrated in FIG. 15, according to an example.
Figure 17:
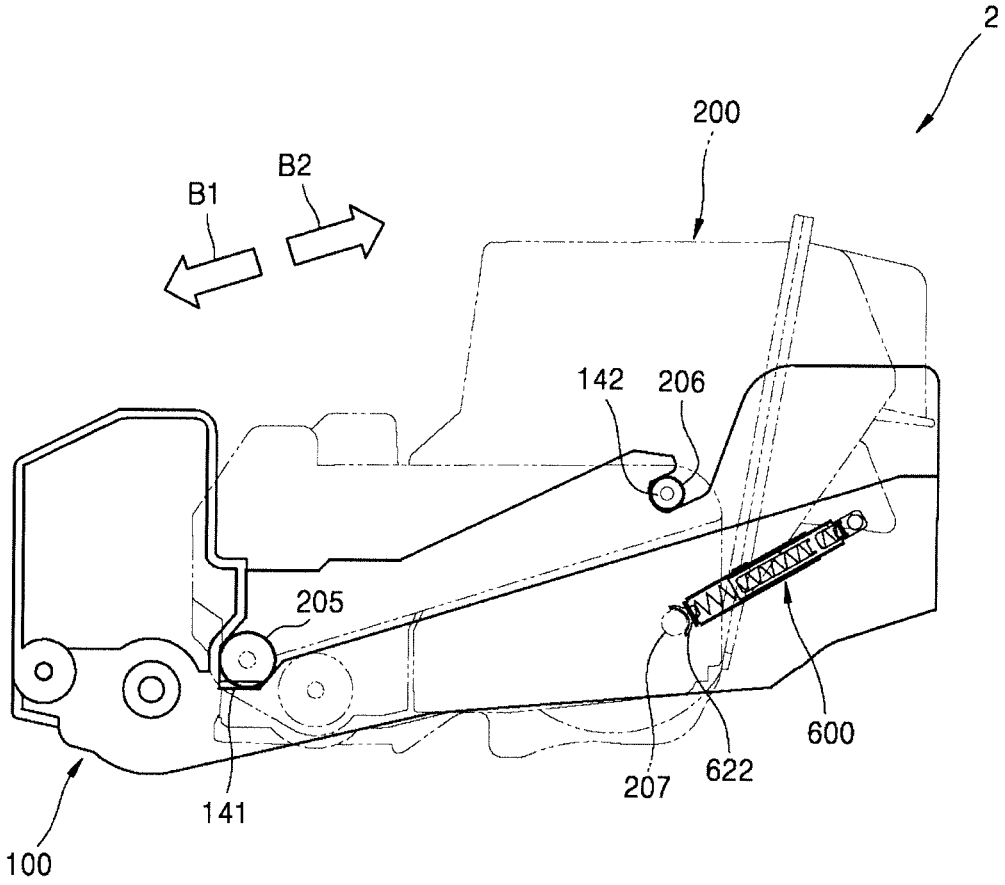
FIG. 17 illustrates a state in which a developing unit is mounted on a mounting portion.

The photosensitive unit 100 and the developing unit 200 may be individually replaced. FIG. 16 is an exploded perspective view of the development cartridge 2 according to an example. FIG. 17 illustrates a state in which the developing unit 200 is mounted on a mounting portion 140. Referring to FIGS. 16 and 17, the photosensitive unit 100 includes the mounting portion 140 from which the developing unit 200 is detachable. The mounting portion 140 may include first and second accommodation portions 141 and 142 and first and second guide rails 143 and 144. The development cartridge 200 includes first and second guide bosses 205 and 206 which are respectively guided by the first and second guide rails 143 and 144. The first and second guide rails 143 and 144 respectively guide the first and second guide bosses 205 and 206 to the first and second accommodation portions 141 and 142. When the first and second guide bosses 205 and 206 are seated on the first and second accommodation portions 141 and 142, the developing roller 22 contacts the photosensitive drum 21, and thus, the development nip N is formed.

The development cartridge 2 may be detached from the main body 1 in a state in which the developing unit 200 is mounted on the photosensitive unit 100. In addition, the developing unit 200 may be detached from the mounting portion 140 in a state in which the photosensitive unit 100 is mounted on the main body 1.

Through the above configuration, the photosensitive unit 100 and the developing unit 200 may be individually mounted on/detached from the main body 1, and thus, it is simple to replace the photosensitive unit 100 or the developing unit 200. In addition, since the photosensitive unit 100 and the developing unit 200 are individually treated during a mounting/detaching process, burden on weight imposed on a user may decrease, and thus, user convenience may improve.

Referring to FIG. 16, the development cartridge 2 includes a pressurizing unit 600. The pressurizing unit 600 is installed at the photosensitive unit 100 and elastically presses the developing unit 200. The pressurizing unit 600 is shifted from the first position to the second position by an operation of mounting the developing unit 200 on the mounting portion 140, and is shifted from the second position to the first position by an operation of detaching the developing unit 200 from the mounting portion 140. The pressurizing unit 600 is shifted to the first and second positions due to interference with the developing unit 200. As an example, the pressurizing unit 600 is mounted on the mounting portion 140 to be rotatable to the first and second positions. At the first position, the pressurizing unit 600 presses the developing unit 200 in a direction of forming the development nip N, and at the second position, the pressurizing unit 600 presses the developing unit 200 in a direction of releasing the development nip N.

Figure 18:
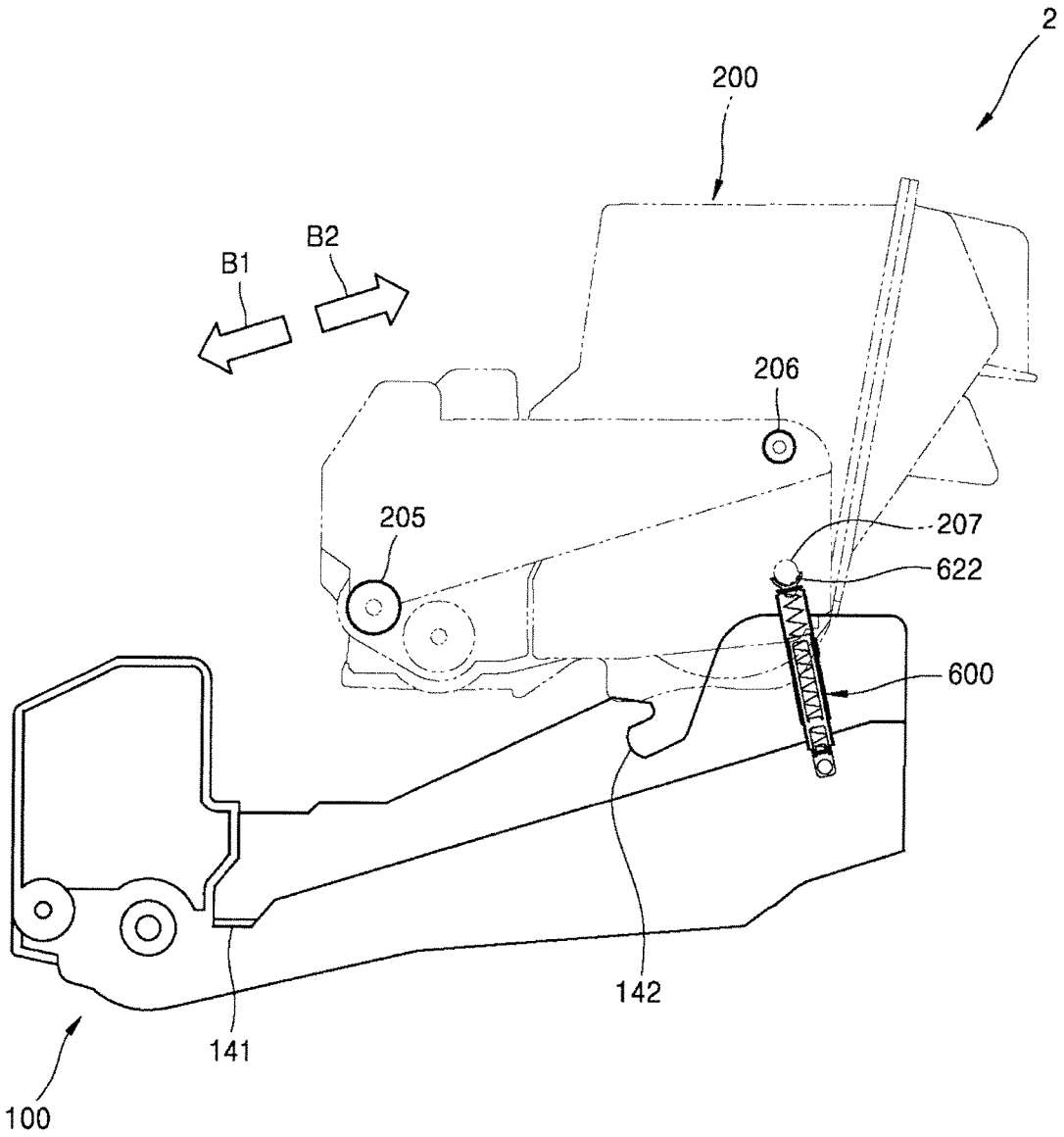
FIG. 18 illustrates a state in which a developing unit is detached from a mounting portion.

FIG. 17 illustrates a state in which the photosensitive drum 21 and the developing roller 22 contact each other to form the development nip N. FIG. 18 illustrates a state in which the photosensitive drum 21 and the developing roller 22 are separated from each other to release the development nip N. Referring to FIGS. 16 to 18, the pressurizing unit 600 is mounted on a rotation shaft 303 provided in the photosensitive unit 100 to be rotatable to the first and second positions. The developing unit 200 includes a pressing portion 207 for receiving a pressing force of the pressurizing unit 600. The pressing portion 207 may be, for example, in a form of a boss protruding from a side portion of the developing unit 200. Referring to FIG. 17, the pressurizing unit 600 is at the first position in a state in which the developing unit 200 is mounted on the mounting portion 140. In this regard, the pressurizing unit 600 applies an elastic force in a direction in which the developing roller 22 and the photosensitive drum 21 contact each other to maintain the development nip N in a formed state to the pressing portion 207. Referring to FIG. 18, the pressurizing unit 600 is at the second position in a state in which the developing unit 200 is detached from the mounting portion 140. In this regard, the pressurizing unit 600 applies an elastic force in a direction in which the developing unit 200 is detached from the mounting portion 140 to the pressing portion 207. That is, a direction of an elastic force is shifted to a direction of maintaining the development nip N in a formed state and a direction of releasing the development nip N according to a position of the pressurizing unit 600.

Figure 19:
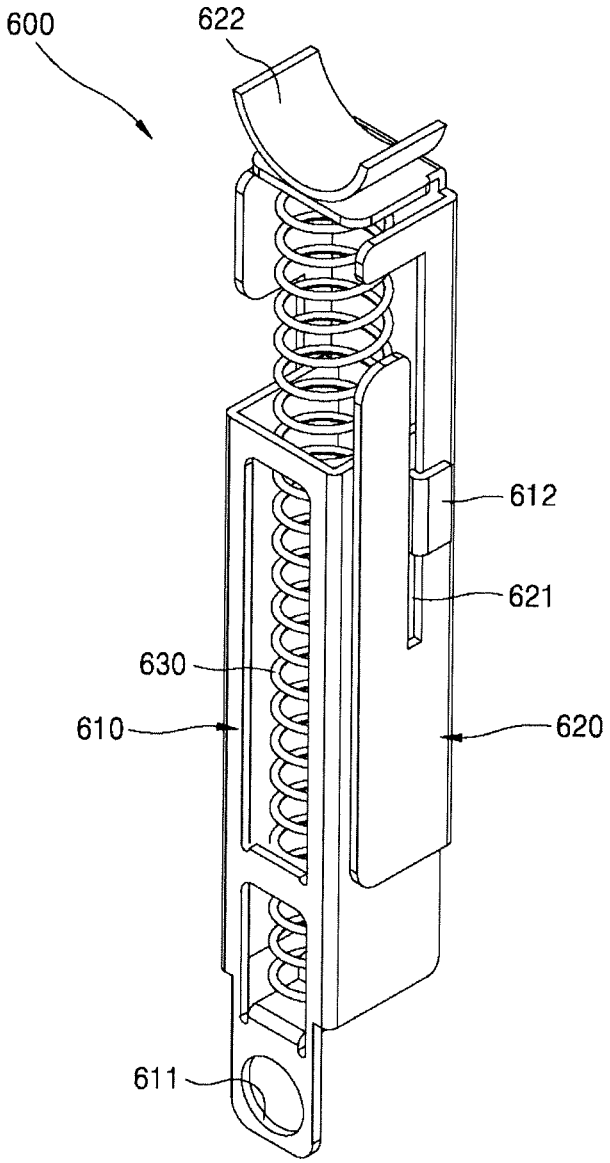
FIG. 19 is a schematic perspective view of a pressurizing unit illustrated in FIG. 16, according to an example.

FIG. 19 is a schematic perspective view of the pressurizing unit 600 according to an example. Referring to FIG. 19, the pressurizing unit 600 may include a rotation member 610, a pressing member 620 for pressing the pressing portion 207, which is slidable on the rotation member 610, and an elastic member 630 for elastically biasing the pressing member 620 in a direction of pressing the pressing portion 207. An end portion of the rotation member 610 includes a hinge hole 611 into which the rotation shaft 303 is inserted. The pressing member 620 is supported to be slidable on the rotation member 610 in a direction of accessing/being separated from the hinge hole 611. For example, the pressing member 620 includes a guide slot 621 extending in a sliding direction, and the rotation member 610 includes a guide protrusion 612 inserted into the guide slot 621. The elastic member 630 is between the rotation member 610 and the pressing member 620 and applies an elastic force to the pressing member 620 to slide in a direction far from the hinge hole 611. In the example, a compressive coil spring having one end and the other end respectively supported by the rotation member 610 and the pressing member 620 is used as the elastic member 630. However, a type and form of the elastic member 630 is not limited to the example illustrated in FIG. 19. A free field of the elastic member 630 is determined such that the pressing member 620 may elastically press the pressing portion 207 when the pressurizing unit 600 is at the first and second positions. An end portion of the pressing member 620 includes a receiving portion 622 having a complementary shape of the pressing portion 207 to receive the pressing portion 207.

The photosensitive unit 100 may include a maintaining unit for maintaining the pressurizing unit 600 in the second position when the developing unit 200 is detached from the mounting portion 140. Referring to FIG. 16, the maintaining unit may include a return spring 650 for elastically biasing the pressurizing unit 600 to rotate in a direction of returning to the second position. The mounting portion 140 may include a stopper 209 for preventing the pressurizing unit 600 from being rotated beyond the second position by an elastic force of the return spring 650. Through the above configuration, when the developing unit 200 is detached from the mounting portion 140, the pressurizing unit 600 may return to the second position and be maintained in the same position.

Figure 20A:
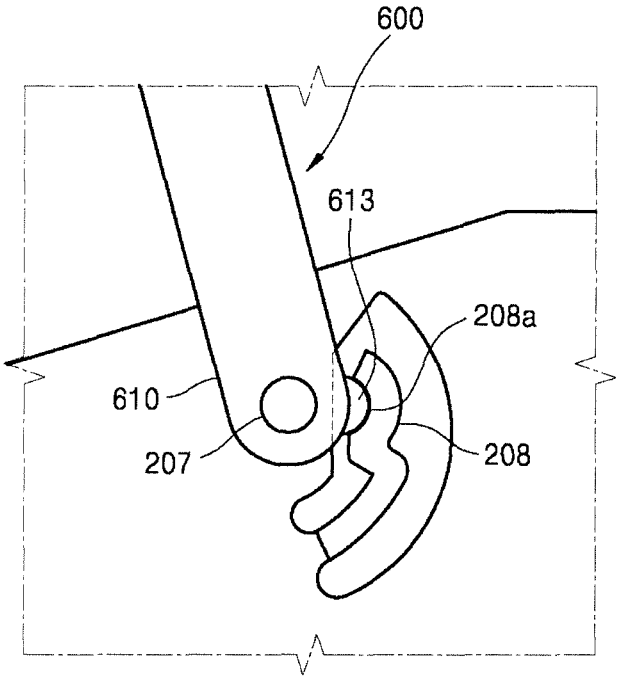
FIGS. 20A and 20B are schematic configuration diagrams illustrating a maintaining unit according to an example.
Figure 20B:
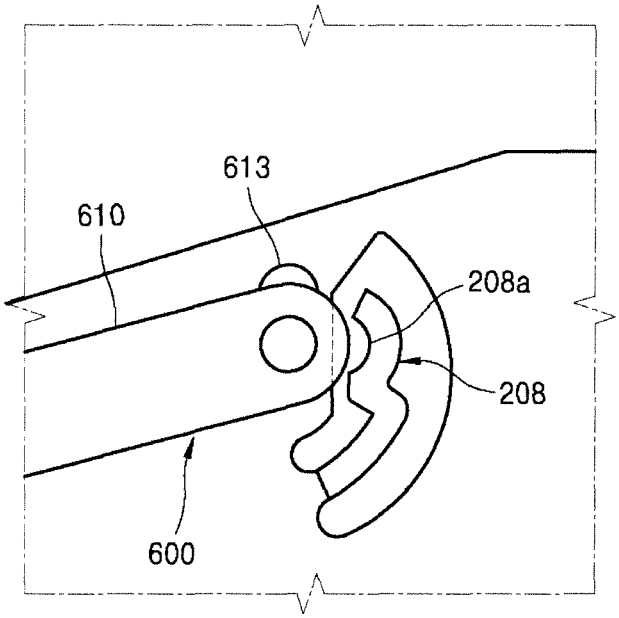

FIGS. 20A and 20B are schematic configuration diagrams illustrating a maintaining unit according to an example. Referring to FIGS. 20A and 20B, the maintaining unit includes an elastic arm 208 in the mounting portion 140. The elastic arm 208 includes a first combining portion 208*a*. The pressurizing unit 600 includes a second combining portion 613 which is engaged with the first combining portion 208*a*. The second combining portion 613 may be provided in the rotation member 610. As an example, the first combining portion 208*a* may have a concave shape and the second combining portion 613 may have a convex shape complementary to that of the first combining portion 208*a*, or the reverse may apply.

Referring to FIG. 20A, when the pressurizing unit 600 is at the second position, the second combining portion 613 may be engaged with the first combining portion 208*a*, and thus, the pressurizing unit 600 may be maintained in the second position. When the pressurizing unit 600 is rotated to the first position in this state, as the elastic arm 208 is pushed by the second combining portion 613 and elastically deformed, the second combining portion 613 may be released from the first combining portion 208*a*, and the pressurizing unit 600 may be rotated to the first position as illustrated in FIG. 20B. When the pressurizing unit 600 is rotated from the first position to the second position, as the pressurizing unit 600 almost gets close to the second position, the second combining portion 613 pushes the elastic arm 208 and thus partially separates the elastic arm 208 from the second combining portion 613, and as the pressurizing unit 600 reaches the second position, the elastic arm 208 returns to the original position, and thus, the first and second combining portions 208*a* and 613 are engaged with each other to maintain the pressurizing unit 600 in the second position.

A process of forming/releasing the development nip N through the above configuration will now be described in detail. A process of releasing the development nip N is described first.

Referring to FIG. 17, the developing unit 200 is mounted on the photosensitive unit 100. The first and second guide bosses 205 and 206 are respectively seated on the first and second accommodation portions 141 and 142. The pressurizing unit 600 is at the first position. The receiving portion 622 of the pressing member 620 receives the pressing portion 207. Due to an elastic force of the elastic member 630, the pressing member 620 pushes the pressing portion 207 in a direction of forming the development nip N. That is, the developing unit 200 is elastically biased in a direction of maintaining the development nip N by an elastic force of the pressurizing unit 600 in the first position. Accordingly, the development nip N may be maintained in a formed state by the elastic force of the pressurizing unit 600.

When the developing unit 200 is moved in the direction B2 of being removed from the mounting portion 140, the elastic member 630 of the pressurizing unit 600 is compressed. When a position where the second guide boss 206 may be escaped from the second accommodation portion 142 is reached, the developing unit 200 is slightly lifted upwards. Thus, the second guide boss 206 is escaped from the second accommodation portion 142, and the pressurizing unit 600 is rotated to the second position with respect to the rotation shaft 207.

Until the pressurizing unit 600 reaches a position parallel to the first guide rail 143 (to be precise, until a direction of an elastic force applied to the developing unit 200 by the pressurizing unit 600 becomes a direction parallel to the first guide rail 143), the elastic force of the pressurizing unit 600 is maintained in a direction of forming the development nip N.

When the pressurizing unit 600 rotates beyond the position parallel to the first guide rail 143, the elastic force of the pressurizing unit 600 is shifted in a direction of releasing the development nip N. Accordingly, the developing unit 200 is detached from the mounting portion 140 more easily by the elastic force of the pressurizing unit 600, and the development nip N is released. The pressurizing unit 600 is rotated to the second position according to detachment of the developing unit 200.

As illustrated in FIG. 18, when the pressurizing unit 600 reaches the second position, the pressurizing unit 600 is maintained in the second position by the maintaining unit described above.

A process of forming the development nip N will be described below.

To mount the developing unit 200 on the photosensitive unit 100, the pressing portion 207 of the developing unit 200 is positioned at the receiving portion 622 of the pressurizing unit 600 in the second position as illustrated in FIG. 18. By pressing the developing unit 200 towards the mounting portion 140 in this state, the first guide boss 205 is brought into contact with the first guide rail 143. In this regard, the pressurizing unit 600 is rotated to the first position with respect to the rotation shaft 303, and an elastic force of the pressurizing unit 600 is applied in a direction of separating the developing unit 200 from the mounting portion 140.

When the developing unit 200 is pushed in the mounting direction B1, the first guide boss 205 is guided by the first guide rail 143, and then, the second guide boss 206 is brought into contact with the second guide rail 144. When the developing unit 200 is continuously pushed in the mounting direction B1, the first and second guide bosses 205 and 206 are respectively guided by the first and second guide rails 143 and 144. The elastic force of the pressurizing unit 600 is applied in the direction of separating the developing unit 200 from the mounting portion 140.

When the pressurizing unit 600 rotates to the first position beyond a position parallel to the first guide rail 143, the elastic force of the pressurizing unit 600 is shifted in a direction of forming the development nip N, the developing unit 200 is moved in the mounting direction B1 by the elastic force of the pressurizing unit 600, and the first and second guide bosses 205 and 206 reach the first and second accommodation portions 141 and 142. The developing roller 22 contacts the photosensitive drum 21, and thus, the development nip N is formed. The pressurizing unit 600 reaches the first position, and the pressing member 620 pushes the pressing portion 207. The development nip N may be maintained in a formed state by the elastic force of the pressurizing unit 600.

While this disclosure has been shown and described with reference to examples thereof, it will be understood by one of ordinary skill in the art that various changes in form and details may be made therein without departing from the spirit and scope as defined by the appended claims.

The invention claimed is:

1. A development cartridge for an image forming apparatus, the development cartridge comprising:

a photosensitive unit including a photosensitive drum;

a developing unit including a developing roller, the developing unit being rotatable with respect to a hinge shaft provided in the photosensitive unit to a development position where a development nip is formed by contact between the developing roller and the photosensitive drum and rotatable with respect to the hinge shaft to a release position where the development nip is released; and a pressurizing unit rotatable in a first direction away from the photosensitive drum to a first position to apply a first elastic force to the developing unit to maintain the developing unit in the development position, and rotatable in a second direction toward the photosensitive drum to a second position to apply a second elastic force to the developing unit to maintain the developing unit in the release position, wherein one end of the pressurizing unit is mounted on a rotation shaft provided in the photosensitive unit to rotate about the rotation shaft, and another end of the pressurizing unit is to contact the developing unit to apply the first elastic force and the second elastic force, and an axis of the hinge shaft and an axis of the rotation shaft are parallel to one another.

2. The development cartridge of claim 1, wherein when the another end of the pressurizing unit rotates in the first direction, the another end of the pressurizing unit is to contact a first pressing portion of the developing unit to apply the first elastic force, the first pressing portion being disposed on one side of the axis of the hinge shaft, and when the another end of the pressurizing unit rotates in the second direction, the another end of the pressurizing unit is to contact a second pressing portion of the developing unit to apply the second elastic force, the second pressing portion being disposed on another side of the axis of the hinge shaft.

3. The development cartridge of claim 1, wherein the pressurizing unit includes:

a rotation member rotatable about the rotation shaft, a pressing member, slidable on the rotation member, to push the developing unit, and an elastic member to apply an elastic force to the pressing member so that the pressing member presses the developing unit, and the developing unit further includes:

a first pressing portion, disposed on one side of the axis of the hinge shaft, contacted by the pressing member when the pressurizing unit is at the first position, and a second pressing portion, disposed on another side of the axis of the hinge shaft, contacted by the pressing member when the pressurizing unit is at the second position.

4. The development cartridge of claim 3, wherein based on a virtual line connecting the hinge shaft and the rotation shaft to each other, the first pressing portion is on one side of the virtual line and the developing roller is on another side of the virtual line, and the second pressing portion is on the another side of the virtual line.

5. The development cartridge of claim 3, wherein the developing unit further includes:

a first stopper to prevent the pressurizing unit from rotating beyond the first position, and a second stopper to prevent the pressurizing unit from rotating beyond the second position.

6. The development cartridge of claim 5, wherein the developing unit further includes:

a first position determiner to maintain the pressurizing unit in the first position, the first position determiner being on a first side of the pressurizing unit and the first stopper being on a second side of the pressurizing unit when the pressurizing unit is at the first position, and a second position determiner to maintain the pressurizing unit in the second position, the second position determiner being on the second side of the pressurizing unit and the second stopper being on the first side of the pressurizing unit when the pressurizing unit is at the second position.

7. A development cartridge for an image forming apparatus, the development cartridge comprising:

a photosensitive unit including a photosensitive drum;

a developing unit including a developing roller, coupled to the photosensitive unit and slidable to a development position where a development nip is formed by contact between the developing roller and the photosensitive drum and slidable to a release position where the development nip is released; and a pressurizing unit including:

one end portion rotatable about a first rotation shaft provided in the photosensitive unit, and another end portion rotatable about a second rotation shaft provided in the developing unit, wherein the pressurizing unit is to rotate in a first direction toward the photosensitive drum to a first position to apply a first elastic force to the developing unit such that the developing unit linearly slides in a third direction and is maintained in the development position, and the pressurizing unit is to rotate in a second direction away from the photosensitive drum to a second position to apply a second elastic force to the developing unit such that the developing unit linearly slides in a fourth direction, opposite of the third direction, and is maintained in the release position.

8. The development cartridge of claim 7, wherein the pressurizing unit includes:

a first rotation member rotatable about the first rotation shaft, a second rotation member rotatable about the second rotation shaft and slidably connected to the first rotation member, and an elastic member to apply an elastic force to the second rotation member so that the second rotating member presses the developing unit, wherein, based on a virtual line passing through the first rotation shaft and perpendicular to a sliding direction of the developing unit, when the pressurizing unit is at the first position, the second rotation shaft is at a same side of the virtual line as the developing roller, and when the pressurizing unit is at the second position, the second rotation shaft is at one side of the virtual line and the developing roller is on another side of the virtual line.

9. The development cartridge of claim 7, wherein one of the photosensitive unit and the developing unit includes a guide slot extending in a sliding direction of the developing unit, the other of the photosensitive unit and the developing unit includes a guide protrusion inserted into the guide slot, and a width of the guide slot in a direction perpendicular to the sliding direction is greater than a width of the guide protrusion.

10. The development cartridge of claim 7, wherein the photosensitive unit further includes a mounting portion where the developing unit is mounted.

11. The development cartridge of claim 10, wherein the developing unit further includes a pressing portion, and the pressurizing unit includes:

a rotation member rotatable with respect to the photosensitive unit;

a pressing member slidable on the rotation member and including a receiving portion to receive the pressing portion, and an elastic member to apply an elastic force to the pressing member so that the pressing member presses the pressing portion.

12. The development cartridge of claim 11, further comprising a maintaining unit, provided in the photosensitive unit, to maintain the pressurizing unit in the second position.

13. The development cartridge of claim 12, wherein the maintaining unit includes:

a return spring to elastically bias the pressurizing unit in a direction of rotation to the second position, and a stopper to prevent the pressurizing unit from rotating beyond the second position.

14. The development cartridge of claim 12, wherein the maintaining unit includes:

an elastic arm including a first combining portion, and a second combining portion, in the pressurizing unit, having a shape complementary to that of the first combining portion so that the second combining portion is coupled to the first combining portion when the pressurizing unit is at the second position.

15. The development cartridge of claim 7, wherein the one end portion is mounted to the first rotation shaft and the another end portion is mounted to the second rotation shaft, and an axis of the first rotation shaft and an axis of the second rotation shaft are parallel to one another.

16. An image forming apparatus, comprising:

a main body; and a development cartridge detachable from the main body, the development cartridge including:

a photosensitive unit including a photosensitive drum, a developing unit including a developing roller, the developing unit being rotatable with respect to a hinge shaft provided in the photosensitive unit to a development position where a development nip is formed by contact between the developing roller and the photosensitive drum and rotatable with respect to the shaft movable to a release position where the development nip is released, and a pressurizing unit rotatable in a first direction away from the photosensitive drum to a first position to apply a first elastic force to the developing unit to maintain the developing unit in the development position, and rotatable in a second direction toward the photosensitive drum to a second position to apply a second elastic force to the developing unit in a second direction to maintain the developing unit in the release position, wherein one end of the pressurizing unit is mounted on a rotation shaft provided in the photosensitive unit to rotate about the rotation shaft, and another end of the pressurizing unit is to contact the developing unit to apply the first elastic force and the second elastic force, and an axis of the hinge shaft and an axis of the rotation shaft are parallel to one another.

* * * * *